US009724914B2

(12) United States Patent
Fujisawa

(10) Patent No.: US 9,724,914 B2
(45) Date of Patent: Aug. 8, 2017

(54) LIQUID DISCHARGING APPARATUS, HEAD UNIT PROVIDED IN LIQUID DISCHARGING APPARATUS, AND CONTROL METHOD OF LIQUID DISCHARGING APPARATUS

(71) Applicant: SEIKO EPSON CORPORATION, Tokyo (JP)

(72) Inventor: Kazuhito Fujisawa, Minowa-machi (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/366,109

(22) Filed: Dec. 1, 2016

(65) Prior Publication Data

US 2017/0173948 A1 Jun. 22, 2017

(30) Foreign Application Priority Data

Dec. 22, 2015 (JP) ..... 2015-249387

(51) Int. Cl.
*B41J 2/045* (2006.01)
*B41J 2/14* (2006.01)

(52) U.S. Cl.
CPC ..... *B41J 2/04588* (2013.01); *B41J 2/04581* (2013.01); *B41J 2/14201* (2013.01)

(58) Field of Classification Search
CPC B41J 2/04588; B41J 2/04581; B41J 2/14201; B41J 2/14233
See application file for complete search history.

(56) References Cited

U.S. PATENT DOCUMENTS 7,150,513 B2 12/2006 Shinkawa et al.
8,425,014 B2 * 4/2013 Ottosson ..... B41J 2/14233 347/68
2015/0054876 A1 2/2015 Nakazawa et al.

FOREIGN PATENT DOCUMENTS

JP 2004-276544 A 10/2004
JP 2015-039856 A 3/2015

* cited by examiner

*Primary Examiner* — Lamson Nguyen
(74) *Attorney, Agent, or Firm* — Global IP Counselors, LLP

(57) ABSTRACT

A liquid discharging apparatus includes a first piezoelectric element that includes a pair of electrodes including a first electrode and that is displaced according to a potential change of a driving signal in a case where the driving signal is supplied to the first electrode, a reference piezoelectric element that includes a pair of electrodes including a reference electrode, an internal space of which a volume changes in response to displacement of the reference piezoelectric element, and a detecting unit that detects a potential of the first electrode via a first wire and detects a potential of the reference electrode via a second wire in a first detection period which is a period after the first piezoelectric element is displaced due to the driving signal, in which the internal space is not filled with the liquid.

10 Claims, 21 Drawing Sheets

HU
20
DETECTION CIRCUIT
NSA
TN1
TN2
Out1
Out2
CS1
CS2
10
11
CONNECTION STATE SPECIFYING CIRCUIT
SLs[4]
SLb[4]
SLa[4]
SLs[3]
SLb[3]
SLa[3]
SLs[2]
SLb[2]
SLa[2]
SLs[1]
SLb[1]
SLa[1]
SL-rf2
SL-rf1
SWa[4]
SWb[4]
SWs[4]
SWs[3]
SWb[3]
SWa[3]
SWs[2]
SWa[2]
SWb[2]
SWs[1]
SWa[1]
SWb[1]
SWrf2
SWrf1
HD
Vin[4]
Vout[4]
Vin[3]
Vout[3]
Vin[2]
Vout[2]
Vin[1]
Vout[1]
Zu[4]
Zd[4]
PZ[4]
Zu[3]
Zd[3]
PZ[3]
Zu[2]
Zd[2]
PZ[2]
Zu[1]
Zd[1]
PZ[1]
Zd-rf
PZ-rf
Zu-rf
LHd
VBS
CL
SI
LAT
CH
Tsig
LHs1
LHs2
LHa
Com-A
Com-B
LHb

FIG. 11A

| Sd[m] | CONTENTS OF SPECIFICATION IN Sd[m] | SLa[m] | | SLb[m] | | | SLs[m] | | |
|---|---|---|---|---|---|---|---|---|---|
| | | Tu1 | Tu2 | TSS1 | TSS2 | TSS3 | TSS1 | TSS2 | TSS3 |
| (1, 1, 0) | LARGE DOT | H | H | L | L | L | L | L | L |
| (1, 0, 0) | MEDIUM DOT | H | L | L | L | L | L | L | L |
| (0, 1, 0) | SMALL DOT | L | H | L | L | L | L | L | L |
| (0, 0, 0) | NON-RECORDING | L | L | L | L | L | L | L | L |
| (1, 1, 1) | DETERMINATION TARGET | L | L | H | L | H | L | H | L |

FIG. 11B

| Sd-rf | CONTENTS OF SPECIFICATION IN Sd-rf | SL-rf1 | | | SL-rf2 | | |
|---|---|---|---|---|---|---|---|
| | | TSS1 | TSS2 | TSS3 | TSS1 | TSS2 | TSS3 |
| (1, 0, 1) | OPERATION FOR DETECTING SIGNAL FROM DISCHARGING UNIT IN GROUP GL1 (FIRST DETECTION OPERATION) | L | L | L | L | H | L |
| (0, 1, 1) | OPERATION FOR DETECTING SIGNAL FROM DISCHARGING UNIT IN GROUP GL2 (SECOND DETECTION OPERATION) | L | H | L | L | L | L |
| (0, 0, 1) | OPERATION FOR NOT DETECTING SIGNAL FROM ANY DISCHARGING UNIT (THIRD DETECTION OPERATION) | L | L | L | L | L | L |

FIG. 14

| Info-S | Info-T (CONTENTS OF NTc COMPARISON) | Stt |
|---|---|---|
| 1 | NTc<Tth1 | 2: DISCHARGE ABNORMALITY (BUBBLES) |
| | Tth1≤NTc≤Tth2 | 1: NORMAL |
| | Tth2<NTc≤Tth3 | 3: DISCHARGE ABNORMALITY (FOREIGN SUBSTANCES) |
| | Tth3<NTc | 4: DISCHARGE ABNORMALITY (INCREASE IN THICKNESS) |
| 0 | N/A | 5: DISCHARGE ABNORMALITY |

FIG. 18

| Sd[m] | DESIGNATION CONTENTS Sd[m] | SLa[m] | | SLb[m] | | | SLs[m] | | |
|---|---|---|---|---|---|---|---|---|---|
| | | Tu1 | Tu2 | TSS1 | TSS2 | TSS3 | TSS1 | TSS2 | TSS3 |
| (1, 1, 0) | LARGE DOT | H | H | L | L | L | L | L | L |
| (1, 0, 0) | MEDIUM DOT | H | L | L | L | L | L | L | L |
| (0, 1, 0) | SMALL DOT | L | H | L | L | L | L | L | L |
| (0, 0, 0) | NON-RECORDING | L | L | L | L | L | L | L | L |
| (1, 1, 1) | DETERMINATION TARGET | L | L | H | L | H | L | H | L |
| (0, 0, 1) | DETECTING OPERATION | L | L | L | L | L | L | H | L |

LIQUID DISCHARGING APPARATUS, HEAD UNIT PROVIDED IN LIQUID DISCHARGING APPARATUS, AND CONTROL METHOD OF LIQUID DISCHARGING APPARATUS

The entire disclosure of Japanese Patent Application No. 2015-249387, filed Dec. 22, 2015 is expressly incorporated by reference herein.

BACKGROUND

1. Technical Field

The present invention relates to a liquid discharging apparatus, a head unit provided in a liquid discharging apparatus, and a control method of a liquid discharging apparatus.

2. Related Art

A liquid discharging apparatus such as an ink jet printer executes a printing process of forming an image on a recording medium by driving and displacing a piezoelectric element provided in a discharging unit using a driving signal to discharge liquid such as ink, with which a cavity (pressure chamber) in the discharging unit is filled, from a nozzle of the discharging unit.

In such a liquid discharging apparatus, a discharge abnormality in which liquid cannot be properly discharged from the discharging unit may occur due to an increase in viscosity of liquid or due to air bubbles intruding into the cavity. Furthermore, when a discharge abnormality occurs, dots which are scheduled to be formed on a medium by liquid discharged from the discharging unit cannot be formed accurately, which causes a decrease in quality of an image formed by the liquid discharging apparatus.

JP-A-2004-276544 suggests a technique of preventing a decrease in image quality due to a discharge abnormality in which residual vibration generated in a discharging unit is detected after a piezoelectric element is driven by a driving signal and a liquid discharge state of the discharging unit is determined on the basis of the result of the detection.

Incidentally, residual vibration generated in the discharging unit is detected as an electromotive force of the piezoelectric element. However, since the amplitude of an electromotive force of the piezoelectric element which is generated by the residual vibration is small, there is a problem that it is not possible to accurately determine an ink discharge state in a case where noise is superimposed on a signal indicating the electromotive force of the piezoelectric element.

SUMMARY

An advantage of some aspects of the invention is to provide a technique of accurately detecting residual vibration generated in a discharging unit.

According to an aspect of the invention, there is provided a liquid discharging apparatus including, a first piezoelectric element that includes a pair of electrodes including a first electrode and that is displaced according to a potential change of a driving signal in a case where the driving signal is supplied to the first electrode, a first pressure chamber of which a volume changes in response to displacement of the first piezoelectric element, a first nozzle from which liquid filling the first pressure chamber can be discharged in response to a change in volume of the first pressure chamber, a reference piezoelectric element that includes a pair of electrodes including a reference electrode, an internal space of which a volume changes in response to displacement of the reference piezoelectric element, and a detecting unit that detects a potential of the first electrode via a first wire and detects a potential of the reference electrode via a second wire in a first detection period which is a period after the first piezoelectric element is displaced due to the driving signal, in which the internal space is not filled with the liquid.

When the first piezoelectric element is displaced, vibration is generated in the discharging unit (hereinafter, referred to as "first discharging unit") including the first piezoelectric element and the first pressure chamber. Accordingly, in the first detection period, a potential of the first electrode is a potential corresponding to residual vibration generated in the first discharging unit. Therefore, it is possible to determine the liquid discharge state of the first discharging unit on the basis of detected residual vibration. However, in a case where a potential of the first electrode is detected via the first wire, a signal (hereinafter, referred to as "first detected signal") actually detected from the first wire is a signal (hereinafter, referred to as "first residual vibration signal") indicating residual vibration generated in the first discharging unit on which a noise due to a potential change of the driving signal is superimposed. Therefore, in a case where the liquid discharge state of the first discharging unit is determined on the basis of the first detected signal, determination accuracy becomes low.

On the other hand, in the aspect of the invention, a potential of the reference electrode is detected via the second wire. In this case, on a signal (hereinafter, referred to as "first reference signal") detected from the second wire, a noise due to a potential change or the like of the driving signal is superimposed as in the case of the first detected signal. Therefore, a noise component superimposed on the first detected signal is canceled out by the first reference signal to extract the first residual vibration signal so that it becomes possible to accurately determine the liquid discharge state of the first discharging unit.

According to another aspect of the invention, there is provided a liquid discharging apparatus including a first piezoelectric element that includes a pair of electrodes including a first electrode and that is displaced according to a potential change of a driving signal in a case where the driving signal is supplied to the first electrode, a first pressure chamber of which a volume changes in response to displacement of the first piezoelectric element, a first nozzle from which liquid filling the first pressure chamber can be discharged in response to a change in volume of the first pressure chamber, a second piezoelectric element that includes a pair of electrodes including a second electrode and that is displaced according to a potential change of the driving signal in a case where the driving signal is supplied to the second electrode, a second pressure chamber of which a volume changes in response to displacement of the second piezoelectric element, a second nozzle from which liquid filling the second pressure chamber can be discharged in response to a change in volume of the second pressure chamber, a reference piezoelectric element that includes a pair of electrodes including a reference electrode, and a detecting unit that detects a potential of the first electrode via a first wire and detects a potential of the reference electrode via a second wire in a first detection period which is a period after the first piezoelectric element is displaced due to the driving signal and that detects a potential of the second electrode via the second wire and detects a potential of the reference electrode via the first wire in a second detection period which is a period after the second piezoelectric element is displaced due to the driving signal.

In the first detection period, a potential of the first electrode is a potential corresponding to residual vibration generated in the first discharging unit. However, in a case where a potential of the first electrode is detected via the first wire, a first detected signal actually detected from the first wire is a first residual vibration signal indicating residual vibration generated in the first discharging unit on which a noise due to a potential change or the like of the driving signal is superimposed.

Similarly, in the second detection period, a potential of the second electrode is a potential corresponding to residual vibration generated in the discharging unit (hereinafter, referred to as "second discharging unit) including the second piezoelectric element and the second pressure chamber. However, in a case where a potential of the second electrode is detected via the second wire, a signal (hereinafter, referred to as "second detected signal") actually detected from the second wire is a signal (hereinafter, referred to as "second residual vibration signal") indicating residual vibration generated in the second discharging unit on which a noise due to a potential change or the like of the driving signal is superimposed.

On the other hand, in the above-described aspect, a potential of the reference electrode is detected via the second wire in the first detection period. In this case, on a first reference signal detected from the second wire, a noise due to a potential change or the like of the driving signal is superimposed. Therefore, a noise component superimposed on the first detected signal is canceled out by the first reference signal to extract the first residual vibration signal so that it becomes possible to accurately determine the liquid discharge state of the first discharging unit.

Similarly, in the above-described aspect, a potential of the reference electrode is detected via the first wire in the second detection period. In this case, on a signal (hereinafter, referred to as "second reference signal") detected from the first wire, a noise due to a potential change or the like of the driving signal is superimposed. Therefore, a noise component superimposed on the second detected signal are canceled out by the second reference signal to extract the second residual vibration signal so that it becomes possible to accurately determine the liquid discharge state of the second discharging unit.

In the liquid discharging apparatus, a plurality of piezoelectric elements including the first piezoelectric element and the second piezoelectric element are provided, and the number of piezoelectric elements with an electrode, of which a potential can be detected by the detecting unit via the first wire, in the plurality of piezoelectric elements may be approximately the same as the number of piezoelectric elements with an electrode, of which a potential can be detected by the detecting unit via the second wire, in the plurality of piezoelectric elements.

According to the above-described aspect, it is possible to approximately equalize a noise sensitivity of the first wire and a noise sensitivity of the second wire by approximately equalizing a capacity value of parasitic capacitance of the first wire and a capacity value of parasitic capacitance of the second wire. Therefore, it is possible to approximately equalize a noise superimposed on the first detected signal and a noise superimposed on the first reference signal in size and to approximately equalize a noise superimposed on the second detected signal and a noise superimposed on the second reference signal in size. Accordingly, it is possible to accurately extract the first residual vibration signal and the second residual vibration signal and to accurately determine the liquid discharge state of the first discharging unit and the second discharging unit.

In the liquid discharging apparatus, the plurality of piezoelectric elements may be arranged extending along a predetermined direction, and the piezoelectric elements with an electrode, of which a potential can be detected by the detecting unit via the first wire, and the piezoelectric elements with an electrode, of which a potential can be detected by the detecting unit via the second wire, may be alternately arranged.

According to the above-described aspect, it is possible to approximately equalize a noise sensitivity of the first wire and a noise sensitivity of the second wire and thus it is possible to accurately determine the liquid discharge state of the first discharging unit and the second discharging unit.

In the liquid discharging apparatus, the driving signal may be supplied to at least a portion of the plurality of piezoelectric elements in the first detection period and the second detection period.

According to the above-described aspect, it is possible to execute a process (hereinafter, referred to as "discharge state determination process") of determining the liquid discharge state of the discharging unit during printing process and thus it is possible to suppress a decrease in convenience due to execution of the discharge state determination process and to prevent a decrease in printing quality at the same time.

The liquid discharging apparatus may further include an internal space of which a volume changes in response to displacement of the reference piezoelectric element, in which the internal space may not be filled with the liquid.

According to the above-described aspect, a piezoelectric element for generating a reference signal is provided in addition to the piezoelectric element as a constitution component of the discharging unit. Therefore, it is possible to execute the discharge state determination process without disturbing the printing process.

Accordingly, it is possible to suppress a decrease in convenience due to execution of the discharge state determination process.

In the liquid discharging apparatus, the detecting unit may output a difference detection signal which indicates a potential difference between a potential detected via the first wire and a potential detected via the second wire.

According to the above-described aspect, in the detecting unit, a noise component superimposed on a detected signal (first detected signal and second detected signal) are canceled out by a reference signal (first reference signal and second reference signal) to extract a difference detection signal. Since the difference detection signal can be regarded as a residual vibration signal (first residual vibration signal and second residual vibration signal) which is a signal indicating residual vibration generated in a discharging unit (first discharging unit and second discharging unit), it is possible to accurately determine the liquid discharge state of the discharging unit (first discharging unit and second discharging unit).

The liquid discharging apparatus may further include a determination unit that determines whether or not a discharging unit which includes the first piezoelectric element, the first pressure chamber, and the first nozzle can discharge liquid filling the first pressure chamber in response to a potential change of the driving signal supplied to the first electrode on the basis of the difference detection signal.

According to the above-described aspect, the liquid discharge state of the discharging unit is determined on the basis of the difference detection signal which accurately indicates residual vibration generated in the discharging unit and from which a noise component is removed, and thus it is possible to maintain a favorable determination accuracy.

According to still another aspect of the invention, there is provided a head unit which is provided in a liquid discharging apparatus, the head unit including a first piezoelectric element that includes a pair of electrodes including a first electrode and that is displaced according to a potential change of a driving signal in a case where the driving signal is supplied to the first electrode, a first pressure chamber of which a volume changes in response to displacement of the first piezoelectric element, a first nozzle from which liquid filling the first pressure chamber can be discharged in response to a change in volume of the first pressure chamber, a reference piezoelectric element that includes a pair of electrodes including a reference electrode, an internal space of which a volume changes in response to displacement of the reference piezoelectric element, and a detecting unit that detects a potential of the first electrode via a first wire and detects a potential of the reference electrode via a second wire in a first detection period which is a period after the first piezoelectric element is displaced due to the driving signal, in which the internal space is not filled with the liquid.

In the aspect of the invention, the first residual vibration signal indicating residual vibration generated in the first discharging unit can be extracted by canceling out a noise component superimposed on the first detected signal which is detected from the first wire using the first reference signal which are detected from the second wire, and thus it is possible to accurately determine the liquid discharge state of the first discharging unit.

According to still another aspect of the invention, there is provided a control method of a liquid discharging apparatus which includes a first piezoelectric element that includes a pair of electrodes including a first electrode and that is displaced according to a potential change of a driving signal in a case where the driving signal is supplied to the first electrode, a first pressure chamber of which a volume changes in response to displacement of the first piezoelectric element, a first nozzle from which liquid filling the first pressure chamber can be discharged in response to a change in volume of the first pressure chamber, a reference piezoelectric element that includes a pair of electrodes including a reference electrode, and an internal space of which a volume changes in response to displacement of the reference piezoelectric element, the method including detecting a potential of the first electrode via a first wire and detecting a potential of the reference electrode via a second wire in a first detection period which is a period after the first piezoelectric element is displaced due to the driving signal, in which the internal space is not filled with the liquid.

In the aspect of the invention, the first residual vibration signal indicating residual vibration generated in the first discharging unit can be extracted by canceling out a noise component superimposed on the first detected signal which is detected from the first wire using the first reference signal which are detected from the second wire, and thus it is possible to accurately determine the liquid discharge state of the first discharging unit.

BRIEF DESCRIPTION OF THE DRAWINGS

The invention will be described with reference to the accompanying drawings, wherein like numbers reference like elements.

FIG. 11A is a diagram for explaining contents of decoding performed by a decoder.

FIG. 11B is a diagram for explaining contents of decoding performed by another decoder.

FIG. 14 is a diagram for explaining a determination result signal.

FIG. 18 is a diagram for explaining contents of decoding performed by a decoder according to the second embodiment.

DESCRIPTION OF EXEMPLARY EMBODIMENTS

Figure 1:
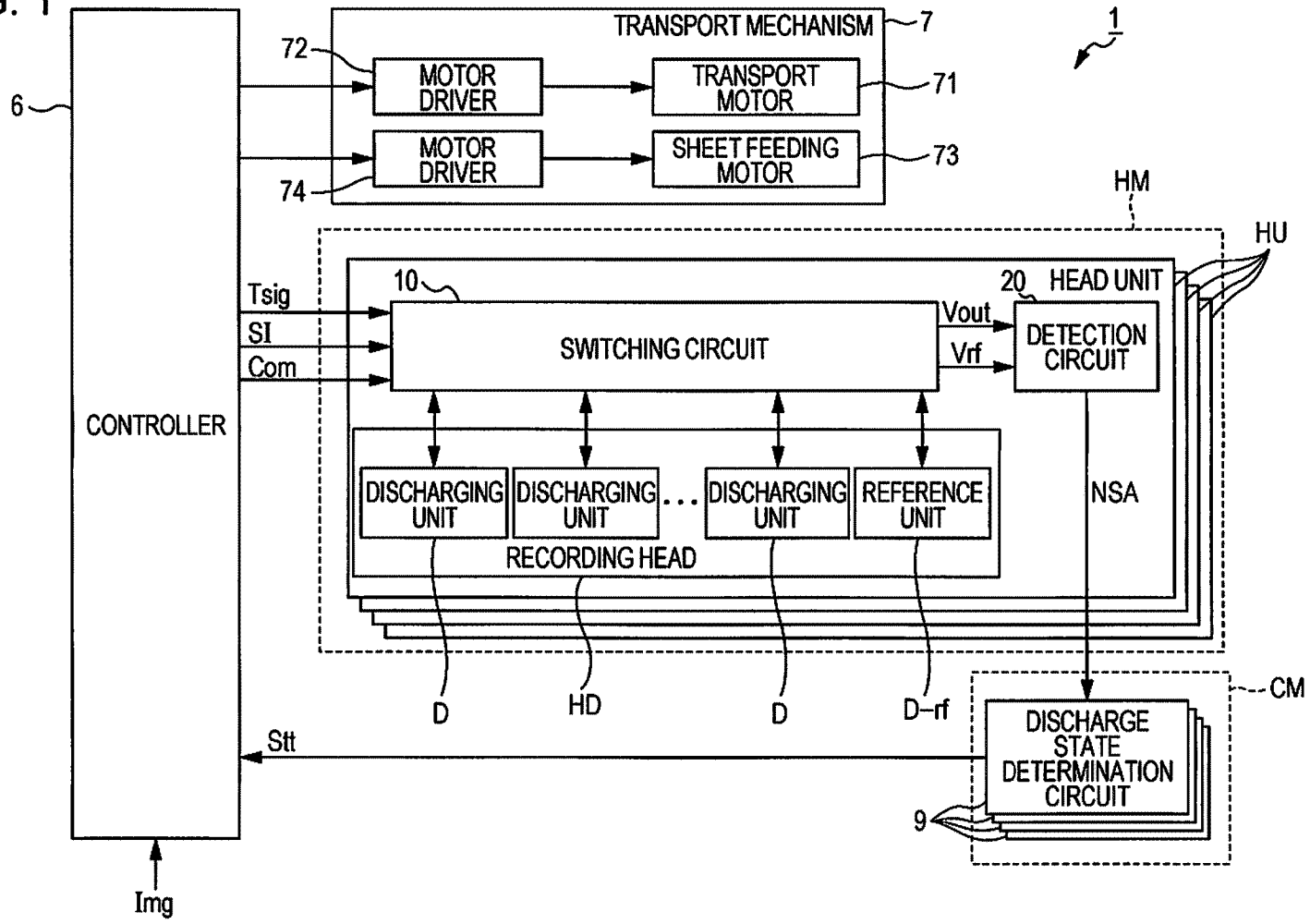
FIG. 1 is a block diagram illustrating a configuration of an ink jet printer according to the invention.

Hereinafter, embodiments of the invention will be described with reference to the drawings. Dimensions and the scale of each component in the drawings are appropriately made different from actual ones. In addition, since the following embodiments are preferred embodiments of the invention, various technically preferable limitations have been applied thereto. However, the scope of the invention is not limited thereto unless there is a particular description below indicating that the invention is limited by the embodiments.

A. First Embodiment

In a first embodiment, a liquid discharging apparatus will be described using an ink jet printer, which forms an image on a recording medium P (an example of "medium") by discharging ink (an example of "liquid"), as an example of the liquid discharging apparatus.

1. Outline of Ink Jet Printer

Figure 2:
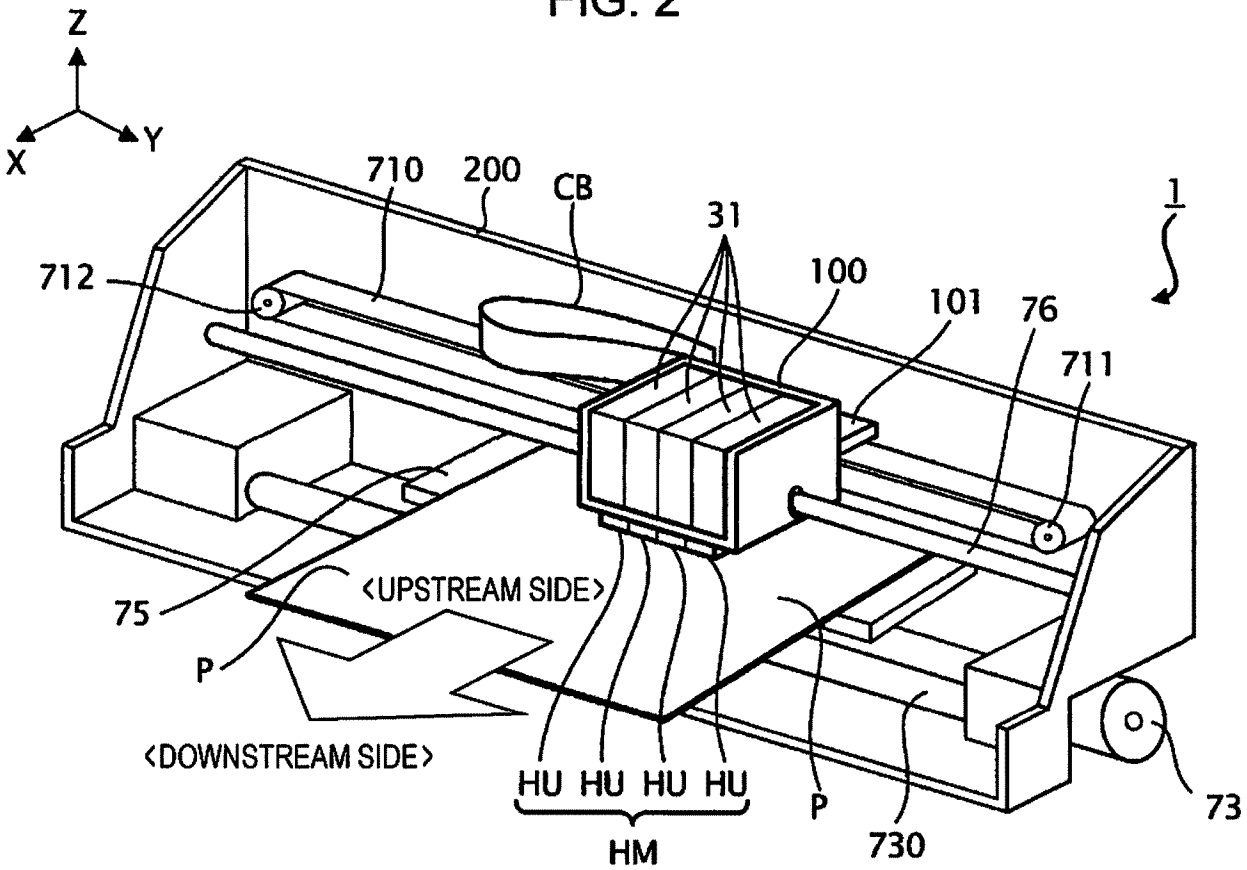
FIG. 2 is a schematic perspective view illustrating an internal configuration of the ink jet printer.

With reference to FIG. 1 and FIG. 2, a configuration of an ink jet printer 1 according to the first embodiment will be described. Here, FIG. 1 is a block diagram illustrating a configuration of an ink jet printer 1 according to the first embodiment. FIG. 2 is a schematic perspective view illustrating an internal configuration of the ink jet printer 1.

Printing data Img indicating an image supposed to be formed by the ink jet printer 1 and information indicating the number of copies of the image supposed to be formed by the ink jet printer 1 are supplied to the ink jet printer 1, from a host computer (not shown) such as a personal computer and a digital camera. The ink jet printer 1 executes a printing process of forming an image indicated by the printing data Img which is supplied from the host computer on the recording medium P.

As illustrated in FIG. 1, the ink jet printer 1 includes a head module HM, a transport mechanism 7, a controller 6, and a determination module CM. The head module HM includes a head unit HU which is provided with a plurality of discharging units D each of which discharges ink. The transport mechanism 7 is for changing relative positions of the head module HM and the recording medium P. The controller 6 controls the operation of each component of the ink jet printer 1. The determination module CM includes a discharge state determination circuit 9 (an example of "determination unit") which determines an ink discharge state of the discharging unit D. Each head unit HU includes a recording head HD including M discharging units D, a switching circuit 10, and a detection circuit 20 (an example of "detecting unit") (in the first embodiment, M is an even number of 2M).

In the first embodiment, it is assumed that the head module HM includes four head units HU and the determination module CM includes four discharge state determination circuits 9. That is, it is assumed that one discharge state determination circuit 9 corresponds to one head unit HU.

In addition, in the first embodiment, it is assumed that the ink jet printer 1 is a serial printer. Specifically, the ink jet printer 1 executes the printing process by discharging ink from the discharging unit D while transporting the recording medium P in a sub scanning direction and moving the head module HM in a main scanning direction. Hereinafter, as illustrated in FIG. 2, a +Y direction and a −Y direction (hereinafter, the +Y direction and the −Y direction are collectively referred to as "Y-axis direction") correspond to the main scanning direction, and a +X direction (hereinafter, the +X direction and a −X direction are collectively referred to as "X-axis direction") corresponds to the sub scanning direction.

As illustrated in FIG. 2, the ink jet printer 1 according to the first embodiment includes a housing 200 and a carriage 100 which can reciprocate in the housing 200 along the Y-axis direction and which is provided with the head module HM mounted thereon.

In a case where the printing process is executed, the transport mechanism 7 causes the carriage 100 to reciprocate in the Y-axis direction and transports the recording medium P in the +X direction so that relative positions of the recording medium P and the head module HM are changed and ink is landed on the entire recording medium P.

Specifically, as illustrated in FIG. 1, the transport mechanism 7 includes a transport motor 71, a motor driver 72, a sheet feeding motor 73, and a motor driver 74. The transport motor 71 is a driving source for causing the carriage 100 to reciprocate in the Y-axis direction. The motor driver 72 is for driving the transport motor 71. The sheet feeding motor 73 is a driving source for transporting the recording medium P in the +X direction. The motor driver 74 is for driving the sheet feeding motor 73. In addition, as illustrated in FIG. 2, the transport mechanism 7 includes a carriage guiding shaft 76 and a timing belt 710. The carriage guiding shaft 76 extends in the Y-axis direction, and the timing belt 710 is suspended between a pulley 711 which is rotated by the transport motor 71 and a rotatable pulley 712 and extends in the Y-axis direction. The carriage 100 is supported by the carriage guiding shaft 76 such that the 100 can reciprocate in the Y-axis direction. In addition, the carriage 100 is fixed to a predetermined portion of the timing belt 710 via a fixing tool 101. Accordingly, when the transport mechanism 7 rotates the pulley 711 using the transport motor 71, the carriage 100 and the head module HM mounted on the carriage 100 are moved in the Y-axis direction along the carriage guiding shaft 76.

In addition, as illustrated in FIG. 2, the transport mechanism 7 includes a platen 75, a sheet feeding roller (not shown), and a sheet discharging roller 730. The platen 75 is provided below (−Z direction) the carriage 100. The sheet feeding roller is rotated in response to driving of the sheet feeding motor 73 and supplies the recording medium P onto the sheet feeding motor 73 one by one. The sheet discharging roller 730 is rotated in response to driving of the sheet feeding motor 73 and transports the recording medium P on the platen 75 toward a sheet discharging port. Therefore, as illustrated in FIG. 2, the transport mechanism 7 can transport the recording medium P from a position on the −X direction side (upstream side) to a position on the +X direction side (downstream side), on the platen 75.

In the first embodiment, as illustrated in FIG. 2, the carriage 100 of the ink jet printer 1 accommodates four ink cartridges 31. More specifically, in the first embodiment, it is assumed that four ink cartridges 31, which respectively correspond to inks of four colors of cyan, magenta, yellow, and black (CMYK), are accommodated in the carriage 100.

Note that, FIG. 2 is merely an example, and the ink cartridge 31 may be provided outside the carriage 100.

The controller 6 includes a memory unit 60 which stores a control program of the ink jet printer 1 and various information such as the printing data Img supplied from the host computer, a central processing unit (CPU), and other various circuits CC. The controller 6 may include a programmable logic device such as a field-programmable gate array (FPGA) instead of the CPU.

Although not shown in FIG. 2, the controller 6 is provided outside the carriage 100. In addition, the controller 6 is electrically connected to the head module HM via a cable CB illustrated in FIG. 2. In the first embodiment, a flexible flat cable is used as the cable CB.

The controller 6 controls the operation of each component in the ink jet printer 1 with the CPU operating according to the control program stored in the memory unit 60. For example, the controller 6 controls the operation of the head module HM and the transport mechanism 7 to execute the printing processing of forming an image according to the printing data Img on the recording medium P.

Here, the outline of the operation of the controller 6 in a case where the printing processing is executed will be described.

In a case where the printing processing is executed, first, the CPU of the controller 6 stores the printing data Img that is supplied from the host computer in the memory unit 60.

Next, the controller 6 generates various signals such as a printing signal SI and a driving signal Com, which are for controlling the operation of each head unit HU, on the basis of various data such as the printing data Img stored in the memory unit 60. Here, the driving signal Com is an analog signal for driving each discharging unit D. Therefore, the various circuits CC which are provided in the controller 6 according to the first embodiment include a D/A conversion circuit, and a digital driving signal generated by the CPU of the controller 6 is converted into an analog driving signal Com in the D/A conversion circuit. In addition, the printing signal SI is a digital signal for specifying the driving mode of each discharging unit D in the printing processing. Specifically, the printing signal SI specifies the driving mode of each discharging unit D by specifying whether the driving signal Com is supplied to each discharging unit D in the printing process. Here, specifying of the driving mode of the discharging unit D means an operation of specifying whether or not ink is to be discharged from the discharging unit D when the discharging unit D is driven, or means an operation of specifying the amount of ink which is discharged from the discharging unit D when the discharging unit D is driven, for example. Although the details will be described below, the printing signal SI may serve as a signal other than a signal for specifying the driving mode of the discharging unit D in the printing process. In addition, although the details will be described below, the driving signal Com includes a driving signal Com-A and a driving signal Com-B.

The controller 6 generates a signal for controlling the operation of the transport mechanism 7 on the basis of the printing signal SI or various data stored in the memory unit 60 so as to control the transport mechanism 7 in such a manner that relative positions of the head module HM and the recording medium P are changed.

In this manner, the controller 6 controls the operation of the head module HM and the transport mechanism 7 using the printing signal SI or other signals. Accordingly, the controller 6 controls each component in the ink jet printer 1 such that the printing process of forming an image according to the printing data Img on the recording medium P is executed while adjusting the presence or absence of an ink discharge from the discharging unit D, the amount of discharged ink, ink discharge timing or the like.

The ink jet printer 1 according to the first embodiment executes a discharge state determination process of determining whether the ink discharge state of each discharging unit D is normal or not, that is, a process of determining whether or not there is a discharge abnormality in each discharging unit D.

Here, the discharge abnormality is a general term for any abnormality in ink discharge state of the discharging unit D, that is, a general term for any state where ink cannot be accurately discharged from a nozzle N (refer to FIGS. 3A and 4 which will be described below) provided in the discharging unit D. More specifically, the discharge abnormality corresponds to a state where the ink cannot be discharged in a mode specified by the driving signal Com even though the discharging unit D is driven using the driving signal Com so that the ink is discharged from the discharging unit D. Here, the ink discharge mode specified by the driving signal Com is a mode in which the discharging unit D discharges the ink by the amount specified according to the waveform of the driving signal Com and the discharging unit D discharges the ink at a discharging rate specified according to the waveform of the driving signal Com. That is, a state where the ink cannot be discharged in the ink discharge mode specified by the driving signal Com includes a state where the ink is discharged from the discharging unit D by the amount smaller than the ink discharge amount specified by the driving signal Com, a state where the ink is discharged from the discharging unit D by the amount larger than the ink discharge amount specified by the driving signal Com, and a state where the ink cannot be landed on a desired landing position on the recording medium P since the ink is discharged at a rate different from the ink discharge rate specified by the driving signal Com, in addition to a state where the ink cannot be discharged from the discharging unit D.

As illustrated in FIG. 1, each head unit HU includes the recording head HD. In addition, each recording head HD includes M discharging units D and a reference unit D-rf. Hereinafter, for distinguishing the M discharging units D in each recording head HD, each of the M discharging units D may be referred to as a first stage discharging unit, a second stage discharging unit, . . . and an Mth stage discharging unit, in a sequence. Hereinafter, an mth stage discharging unit D may be referred to as a discharging unit D[m] (a variable m is a natural number satisfying $1 \leq m \leq M$). Hereinafter, in a case where a constitution component of the ink jet printer 1, a signal, or the like corresponds to a stage number m of the discharging unit D[m], a suffix [m] may be added to a reference symbol of the constitution component or the signal to indicate that the constitution component or the signal corresponds to the stage number m.

In the first embodiment, four head units HU and four ink cartridges 31 are provided so that one head unit HU corresponds to one ink cartridge 31. In addition, each discharging unit D receives ink supplied from the ink cartridge 31 which corresponds to the head unit HU that belongs to the discharging unit D. In this manner, the inside of each discharging unit D is filled with the supplied ink, and each discharging unit D can discharge the ink filling the inside thereof from the nozzle N. That is, total 4M discharging units provided in the head module HM can discharge inks of four colors of CMYK as a whole. Therefore, the ink jet printer 1 can print a full color image using the inks of four colors of CMYK.

As illustrated in FIG. 1, each head unit HU includes the switching circuit 10 and the detection circuit 20 in addition to the recording head HD.

The switching circuit 10 switches whether to supply the driving signal Com which is output from the controller 6 to each discharging unit D. In addition, the switching circuit 10 switches whether to electrically connect each discharging unit D to the detection circuit 20.

The detection circuit 20 generates a residual vibration signal NSA that indicates vibration (hereinafter, referred to as "residual vibration") remaining in the discharging unit D after the discharging unit D is driven on the basis of a detected signal Vout which is detected from the discharging unit D driven by the driving signal Com and a reference signal Vrf detected from the reference unit D-rf.

As illustrated in FIG. 1, the discharge state determination circuit 9 provided in the determination module CM determines the ink discharge state of the discharging unit D on the basis of the residual vibration signal NSA (hereinafter, referred to as "discharge state determination") and generates a determination result signal Stt which indicates the result in the discharge state determination. Hereinafter, the discharging unit D which is the target of the discharge state determination performed by the discharge state determination circuit 9 is referred to as a determination target discharging unit D-H.

The above-described discharge state determination process is a series of processes related to the discharge state determination process in which the discharge state determination executed by the discharge state determination circuit 9 and a preparing process for executing the discharge state determination process executed by the discharge state determination circuit 9 are included.

Specifically, as the discharge state determination process, a series of processes is executed in which, first, the controller 6 selects the determination target discharging unit D-H from M discharging units D in each head unit HU, second, the determination target discharging unit D-H is driven under control of the controller 6 to generate residual vibration in the determination target discharging unit D-H, third, the detection circuit 20 generates the residual vibration signal NSA on the basis of the detected signal Vout which is detected from the determination target discharging unit D-H in which the residual vibration is generated and the reference signal Vrf which is detected from the reference unit D-rf, and fourth, the discharge state determination circuit 9 performs the discharge state determination on the determination target discharging unit D-H on the basis of the residual vibration signal NSA and generates the determination result signal Stt which indicates the result in the determination.

2. Outline of Recording Head and Discharging Unit

The recording head HD, the discharging unit D and the reference unit D-rf provided in the recording head HD will be described with reference to FIGS. 3A, 3B, and 4.

Figure 3A:
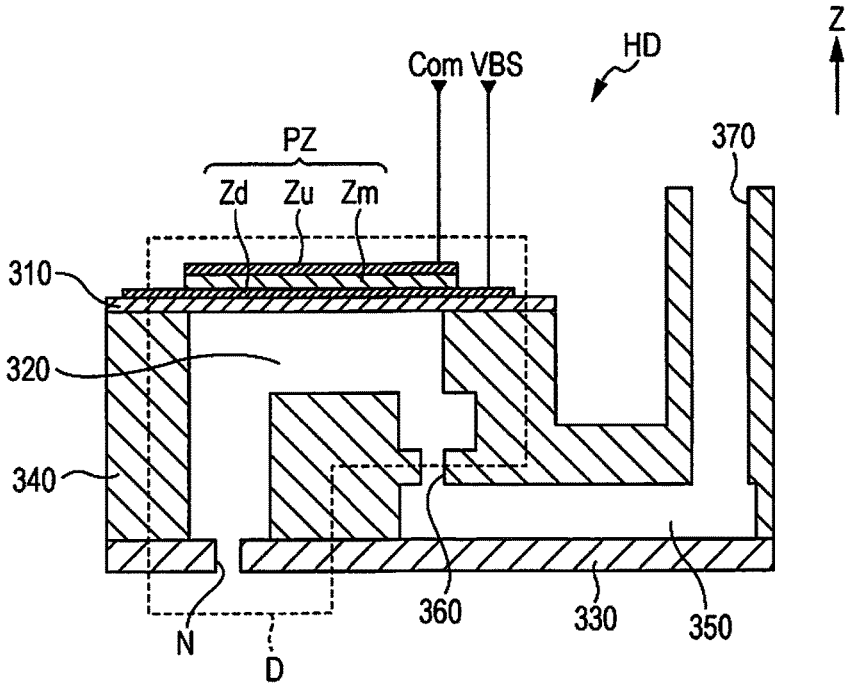
FIG. 3A is a view illustrating a configuration of a discharging unit.

FIG. 3A is a schematic partial sectional view of the recording head HD in which the discharging unit D is included.

As illustrated in FIG. 3A, the discharging unit D includes a piezoelectric element PZ, a cavity 320 (an example of "pressure chamber") which is filled with ink, the nozzle N which communicates with the cavity 320, and a vibration plate 310. The discharging unit D discharges ink in the cavity 320 from the nozzle N when the driving signal Com is supplied to the piezoelectric element PZ and the piezoelectric element PZ is driven by the driving signal Com. The cavity 320 is a space defined by a cavity plate 340, a nozzle plate 330 on which the nozzle N is formed, and the vibration plate 310. The cavity 320 communicates with a reservoir 350 via an ink supplying port 360. The reservoir 350 communicates with the ink cartridge 31 corresponding to the discharging unit D via an ink intake port 370.

Figure 3B:
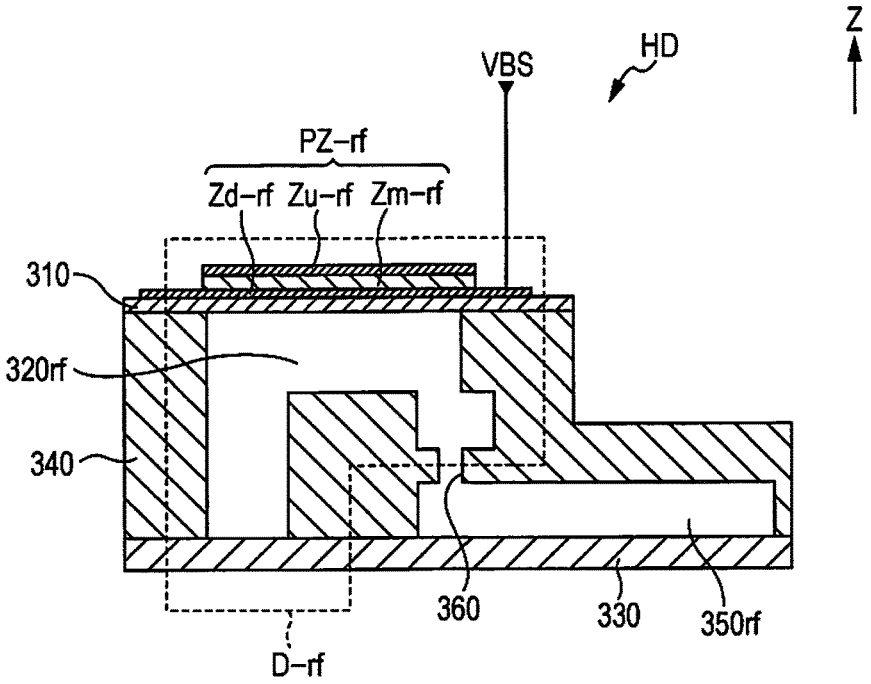
FIG. 3B is a view illustrating a configuration of a reference unit.

In the first embodiment, as the piezoelectric element PZ, a unimorph (monomorph) piezoelectric element as illustrated in FIGS. 3A and 3B is used. Note that, the piezoelectric element PZ is not limited to the unimorph piezoelectric element and may be a bimorph piezoelectric element or a laminated piezoelectric element.

The piezoelectric element PZ includes an upper electrode Zu, a lower electrode Zd, and a piezoelectric body Zm which is provided between the upper electrode Zu and the lower electrode Zd. In addition, the lower electrode Zd is electrically connected to a power supplying line LHd (refer to FIG. 6) set to have a predetermined potential VBS, and when a voltage is applied between the upper electrode Zu and the lower electrode Zd with the driving signal Com supplied to the upper electrode Zu, the piezoelectric element PZ is displaced in the +Z direction or the −Z direction (hereinafter, the +Z direction and the −Z direction are collectively referred to as "Z-axis direction") according to the applied voltage. As a result, the piezoelectric element PZ is vibrated.

The vibration plate 310 is installed on an opening portion on an upper surface of the cavity plate 340. The lower electrode Zd is bonded to the vibration plate 310. Therefore, when the piezoelectric element PZ is driven by the driving signal Com and is vibrated, the vibration plate 310 is also vibrated. Then, the volume of the cavity 320 (pressure in the cavity 320) changes due to the vibration of the vibration plate 310, and the ink filling the cavity 320 is discharged from the nozzle N. In a case where the amount of ink in the 320 is decreased due to the ink discharge operation, ink is supplied to the cavity 320 from the reservoir 350. In addition, ink is supplied to the reservoir 350 from the ink cartridge 31 via the ink intake port 370.

FIG. 3B is a schematic partial sectional view of the recording head HD in which the reference unit D-rf is included.

As illustrated in FIG. 3B, the reference unit D-rf includes a piezoelectric element PZ-rf (an example of "reference piezoelectric element"), the vibration plate 310, and a cavity 320*rf* (an example of "internal space") which is a space that communicates with a pseudo reservoir 350*rf* via the ink supplying port 360 and is defined by the cavity plate 340, the nozzle plate 330, and the vibration plate 310.

The piezoelectric element PZ-rf is a unimorph piezoelectric element as with the piezoelectric element PZ. However, the piezoelectric element PZ-rf may be a bimorph piezoelectric element or a laminated piezoelectric element. The piezoelectric element PZ-rf includes an upper electrode Zu-rf (an example of "reference electrode"), a lower electrode Zd-rf, and a piezoelectric body Zm-rf provided between the upper electrode Zu-rf and the lower electrode Zd-rf. The lower electrode Zd-rf is electrically connected to the power supplying line LHd set to have the predetermined potential VBS. The upper electrode Zu-rf is not connected to any conductive material and is in a floating state.

The pseudo reservoir 350*rf* does not communicate with the ink intake port 370, and ink is not supplied to the pseudo reservoir 350*rf* from the ink cartridge 31. Therefore, the cavity 320*rf* is not filled with the ink. In addition, the nozzle N is not provided on a portion of the nozzle plate 330 on the −Z side of the cavity 320*rf*.

As described above, the reference unit D-rf is different from the discharging unit D in that the nozzle N is not provided, that the ink is not supplied to the cavity 320*rf*, and that the upper electrode Zu-rf is in a floating state with the driving signal Com being not supplied to the upper electrode Zu-rf.

Note that, the reference unit D-rf illustrated in FIG. 3B is merely an example, and the configuration of the reference unit D-rf is not limited as long as the reference unit D-rf includes at least the piezoelectric element PZ-rf. Furthermore, the reference unit D-rf may be configured without the vibration plate 310, the cavity 320 *rf*, or the like. In addition, the upper electrode Zu-rf of the piezoelectric element PZ-rf illustrated in the FIG. 3B is not connected to any conductive material, and is in the floating state. However, this is merely an example, and the upper electrode Zu-rf may be electrically connected to a power supplying line set to have a predetermined potential. For example, the upper electrode Zu-rf may be connected to a power supplying line set to have a reference potential V0.

Next, an ink discharging operation of the discharging unit D will be described with reference to FIG. 4.

Figure 4:
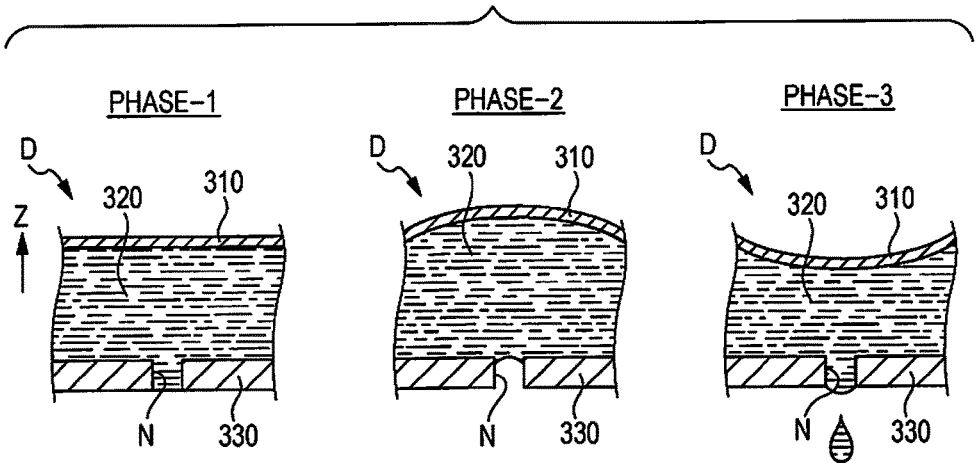
FIG. 4 is a diagram for explaining an ink discharging operation in the discharging unit.

FIG. 4 is a diagram for explaining the ink discharging operation of the discharging unit D. As illustrated in FIG. 4, in a Phase-1 state, for example, the controller 6 changes the potential of the driving signal Com supplied to the piezoelectric element PZ included in the discharging unit D to cause distortion in which the piezoelectric element PZ is displaced in the +Z direction so that the vibration plate 310 of the discharging unit D is bent in the +Z direction. Accordingly, as in a Phase-2 state illustrated in FIG. 4, the volume of the cavity 320 of the discharging unit D is increased in comparison with the Phase-1 state. Next, in the Phase-2 state, for example, the controller 6 changes the potential of the driving signal Com to cause distortion in which the piezoelectric element PZ is displaced in the −Z direction so that the vibration plate 310 of the discharging unit D is bent in the −Z direction. Accordingly, as in a Phase-3 state illustrated in FIG. 4, the volume of the cavity 320 is rapidly decreased and a portion of the ink filling the cavity 320 is discharged from the nozzle N that communicates with the cavity 320 in the form of ink droplets.

Residual vibration is generated in the discharging unit D including the vibration plate 310 after the piezoelectric element PZ and the vibration plate 310 are driven by the driving signal Com and are displaced in the Z-axis direction as illustrated in FIG. 4.

Note that, the driving signal Com is not supplied to the piezoelectric element PZ-rf of the reference unit D-rf. Accordingly, if there is no disturbance such as external vibration or the like, the piezoelectric element PZ-rf of the reference unit D-rf is not displaced in principle. Therefore, in the reference unit D-rf, the residual vibration is not generated in principle.

Figure 5:
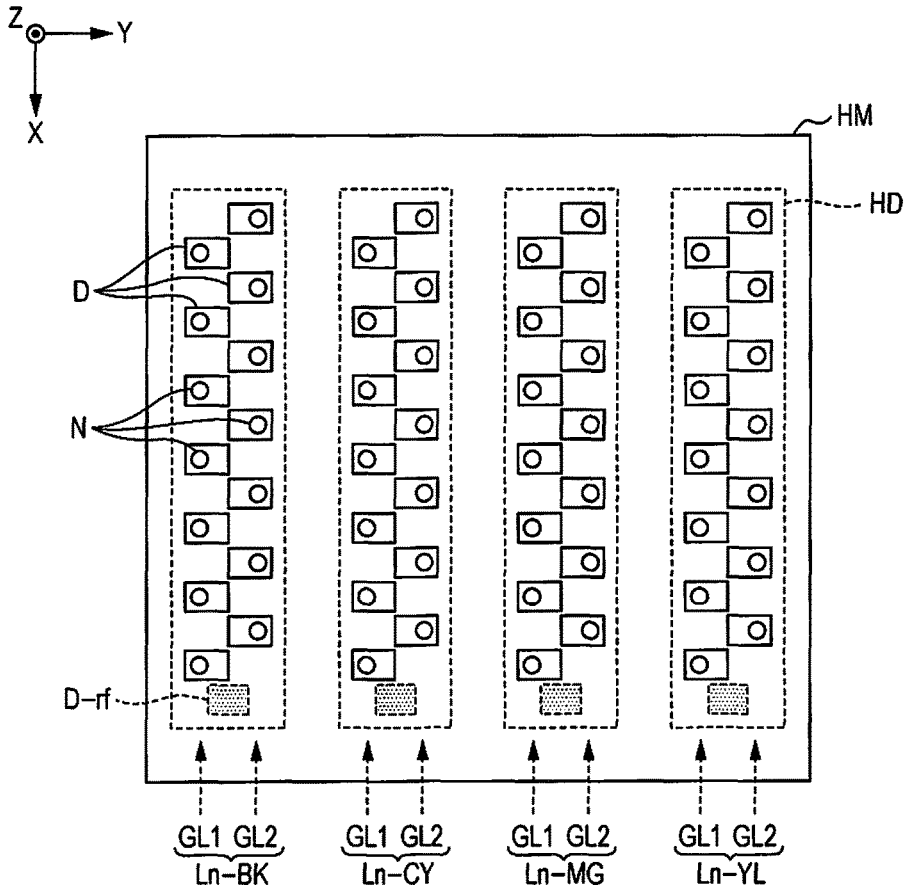
FIG. 5 is a plan view illustrating an arrangement example of nozzles in a head module.

FIG. 5 is a view which illustrates four recording heads HD provided in the head module HM in a case where the ink jet printer 1 is seen from the top along the +Z direction or the −Z direction and an arrangement example of total 4M nozzles N which are provided in the four recording heads HD.

As illustrated in FIG. 5, each recording head HD provided in the head module HM is provided with a plurality of nozzle arrays Ln. Here, the nozzle array Ln is a plurality of nozzles N which are provided extending in a predetermined direction in the form of array. In the first embodiment, it is assumed that each nozzle array Ln is constituted of M nozzles N which are arranged extending in the X-axis direction in the form of array. In addition, in the specification, "array" includes an array with predetermined intervals in addition to an array in which constitution components of the array are arranged forming a straight line in the strict sense. In the first embodiment, it is assumed that the M nozzles N in each nozzle array Ln are arranged zigzag so that positions in the Y-axis direction of even-numbered nozzles N from the +X side and odd-numbered nozzles N are different from each other.

Hereinafter, as illustrated in FIG. 5, four nozzle arrays Ln provided in the head module HM are referred to as a nozzle array Ln-BK, a nozzle array Ln-CY, a nozzle array Ln-MG, and a nozzle array Ln-YL, respectively. Here, the nozzle array Ln-BK is a nozzle array Ln in which nozzles N of the discharging unit D for discharging black ink are arranged, the nozzle array Ln-CY is a nozzle array Ln in which nozzles N of the discharging unit D for discharging cyan ink are arranged, the nozzle array Ln-MG is a nozzle array Ln in which nozzles N of the discharging unit D for discharging magenta ink are arranged, and the nozzle array Ln-YL is a nozzle array Ln in which nozzles N of the discharging unit D for discharging yellow ink are arranged.

The nozzle array Ln illustrated in FIG. 4 is merely an example. The M nozzles N in each nozzle array Ln may be arranged forming a straight line, and each nozzle array Ln may extend in a direction different from the X-axis direction. In the first embodiment, a case where the number of nozzle arrays Ln provided in each recording head HD is one has been described. However, each recording head HD may be provided with two or more nozzle arrays Ln.

As illustrated in FIG. 5, the M discharging units D provided in each head unit HU are classified into two groups. That is, the M discharging units D provided in each head unit HU are classified into a group GL1 and a group GL2.

How the M discharging units D are classified into the two groups is not limited. In the first embodiment, for example, discharging units D corresponding to the odd-numbered nozzles N from the +X side of the M nozzles N in each nozzle array Ln are classified as the group GL1 and discharging units D corresponding to the even-numbered nozzles N from the +X side of the M nozzles N in each nozzle array Ln are classified as the group GL2. As described above, in the first embodiment, M is an even number of 2 or higher. Therefore, for example, in a case where a natural number Mo satisfying "M=2Mo" is introduced, total Mo discharging units D of a first stage discharging unit, a third stage discharging unit, . . . and a (M−1)th stage discharging unit belong to the group GL1 and total Mo discharging units D of a second stage discharging unit, a fourth stage discharging unit, . . . and an Mth stage discharging unit belong to the group GL2. Hereinafter, a variable m for representing a stage number of the discharging unit D belonging to the group GL1 may be referred to as a variable m1, and a variable m for representing a stage number of the discharging unit D belonging to the group GL2 may be referred to as a variable m2. In the first embodiment, it is assumed that the odd-numbered discharging units D belong to the group GL1 and the even-numbered discharging units D belong to the group GL2, and thus the variable m1 indicates 1, 3, . . . or M−1, and the variable m2 indicates 2, 4, . . . or M.

In the first embodiment, the M nozzles N in each nozzle array Ln are arranged zigzag. Therefore, in FIG. 5, the discharging units D belonging to the group GL1 are positioned on the −Y side of each nozzle array Ln and the discharging units D belonging to the group GL2 are positioned on the +Y side of each nozzle array Ln, for example. However, in a case where the M nozzles N in each nozzle array Ln are arranged forming a straight line, the discharging units D belonging to the group GL1 and the discharging units D belonging to the group GL2 are alternately arranged forming the straight line.

As described above, in the first embodiment, each recording head HD is provided with the reference unit D-rf. In the first embodiment, a case where each recording head HD is provided with one reference unit D-rf as illustrated in FIG. 5 has been described. However, each recording head HD may be provided with a plurality of reference units D-rf.

3. Configuration of Head Unit

Hereinafter, the configuration of each head unit HU will be described with reference to FIG. 6.

Figure 6:
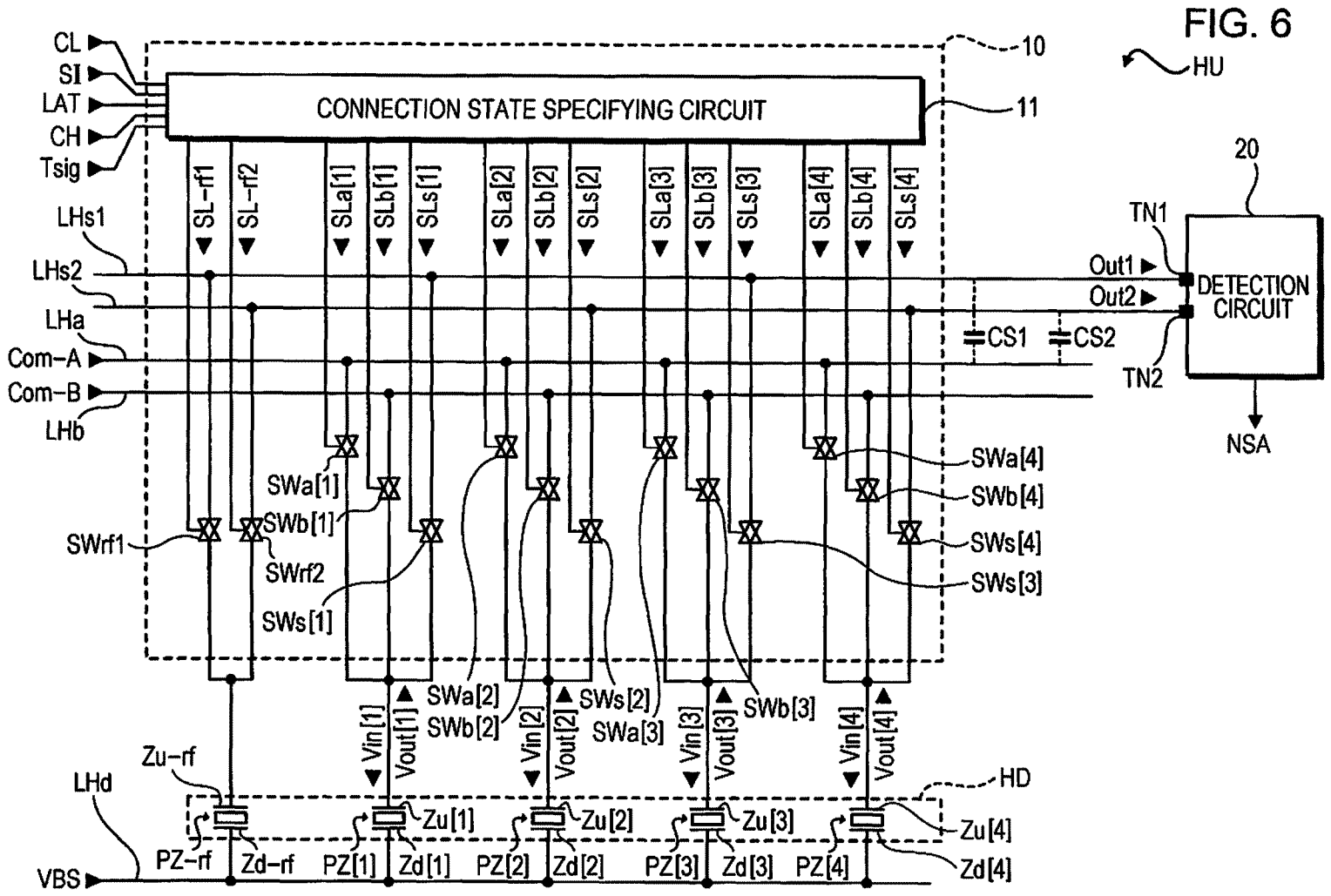
FIG. 6 is a block diagram illustrating a configuration of a head unit.

FIG. 6 is a block diagram illustrating an example of the configuration of the head unit HU. As described above, the head unit HU includes the recording head HD, the switching circuit 10, and the detection circuit 20. In addition, the head unit HU includes an internal wire LHa via which a driving signal Com-A is supplied from the controller 6, an internal wire LHb via which a driving signal Com-B is supplied from the controller 6, an internal wire LHs1 for supplying the detected signal Vout, which is detected from the discharging unit D belonging to the group GL1, to the detection circuit 20, and an internal wire LHs2 for supplying the detected signal Vout, which is detected from the discharging unit D belonging to the group GL2, to the detection circuit 20.

Note that, regarding FIG. 6, it is assumed that four discharging units D are provided in the recording head HD, that is, it is assumed that M=4. In addition, regarding FIG. 6, it is assumed that two discharging units D[1] and D[3] belong to the group GL1 and that two discharging units D[2] and D[4] belong to the group GL2.

In addition, although the details will be described below, in the first embodiment, for example, it is assumed that the driving signal Com-A is a signal with large amplitude which is for driving the discharging unit D in the printing process, and it is assumed that the driving signal Com-B is a signal with smaller amplitude than the driving signal Com-A which is for driving the discharging unit D in the discharge state determination process.

As illustrated in FIG. 6, the switching circuit 10 includes M switches SWa (Swa[1 ] to Swa[M]), M switches SWb (Swb[1] to Swb[M]), M switches SWs (Sws[1] to Sws[M]), switches SWrf1 and SWrf2, and a connection state specifying circuit 11 which specifies the connection state of each switch. As each of the switches, for example, a transmission gate may be used.

The connection state specifying circuit 11 generates connection state specifying signals SLa[1] to SLa[M] for specifying ON and OFF of switches SWa[1] to SWa[M], connection state specifying signals SLb[1] to SLb[M] for specifying ON and OFF of switches SWb[1] to SWb[M], connection state specifying signals SLs[1] to SLs[M] for specifying ON and OFF of switches SWs[1] to SWs[M], a connection state specifying signal SL-rf1 for specifying ON and OFF of the switch SWrf1, and a connection state specifying signal SL-rf2 for specifying ON and OFF of the switch SWrf2, on the basis of at least of a portion of the printing signal SI, a latch signal LAT, a change signal CH, and a period specifying signal Tsig which are supplied from the controller 6.

The switch SWrf1 switches connection and disconnection between the internal wire LHs1 and the upper electrode Zu-rf of the piezoelectric element PZ-rf provided in the reference unit D-rf according to the connection state specifying signal SL-rf1. For example, the switch SWrf1 is turned ON in a case where the connection state specifying signal SL-rf1 is at a high level and is turned OFF in a case where the connection state specifying signal SL-rf1 is at a low level.

The switch SWrf2 switches connection and disconnection between the internal wire LHs2 and the upper electrode Zu-rf of the piezoelectric element PZ-rf provided in the reference unit D-rf according to the connection state specifying signal SL-rf2. For example, the switch SWrf2 is turned ON in a case where the connection state specifying signal SL-rf2 is at a high level and is turned OFF in a case where the connection state specifying signal SL-rf2 is at a low level.

The switch SWa[m] switches connection and disconnection between the internal wire LHa and the upper electrode Zu[m] of the piezoelectric element PZ[m] provided in the discharging unit D[m] according to the connection state specifying signal SLa[m]. For example, the switch SWa[m] is turned ON in a case where the connection state specifying signal SLa[m] is at a high level and is turned OFF in a case where the connection state specifying signal SLa[m] is at a low level.

The switch SWb[m] switches connection and disconnection between the internal wire LHb and the upper electrode Zu[m] of the piezoelectric element PZ[m] provided in the discharging unit D[m] according to the connection state specifying signal SLb[m]. For example, the switch SWb[m] is turned ON in a case where the connection state specifying signal SLb[m] is at a high level and is turned OFF in a case where the connection state specifying signal SLb[m] is at a low level.

Note that, a signal which is actually supplied to the piezoelectric element PZ[m] of the discharging unit D[m] via the switch SWa[m] or the switch SWb[m] of the driving signal Com-A and the driving signal Com-B may be referred to as a supplied driving signal Vin[m].

The switch SWs[m1] with a stage number m1corresponding to the group GL1, that is, the odd-numbered switch SWs[m] switches connection and disconnection between the internal wire LHs1 and the upper electrode Zu[m1] of the piezoelectric element PZ[m1] provided in the discharging unit D[m1] according to the connection state specifying signal SLs[m] (SLs[m1]).

The switch SWs[m2] with a stage number m2corresponding to the group GL2, that is, the even-numbered switch SWs[m] switches connection and disconnection between the internal wire LHs2 and the upper electrode Zu[m2] of the piezoelectric element PZ[m2] provided in the discharging unit D[m2] according to the connection state specifying signal SLs[m] (SLs[m2]).

In an example illustrated in FIG. 6, the switch SWs[1] switches connection and disconnection between the internal wire LHs1 and the upper electrode Zu[1] of the piezoelectric element PZ[1], the switch SWs [2] switches connection and disconnection between the internal wire LHs2 and the upper electrode Zu[2] of the piezoelectric element PZ[2], the switch SWs[3] switches connection and disconnection between the internal wire LHs1 and the upper electrode Zu[3] of the piezoelectric element PZ[3], and the switch SWs[4] switches connection and disconnection between the internal wire LHs2 and the upper electrode Zu[4] of the piezoelectric element PZ[4]. For example, the switch SWs [m] is turned ON in a case where the connection state specifying signal SLs[m] is at a high level and is turned OFF in a case where the connection state specifying signal SLs[m] is at a low level.

The detection circuit 20 generates the residual vibration signal NSA on the basis of the detected signal Vout[m] which is supplied from one of the internal wire LHs1 and the internal wire LHs2 and the reference signal Vrf is supplied from the other of the internal wire LHs1 and the internal wire LHs2.

Hereinafter, for convenience of explanation, a signal such as the detected signal Vout[m] or the reference signal Vrf which is supplied to the detection circuit 20 via the internal wire LHs1 as illustrated in FIG. 6 is referred to as a signal Out1 and a signal such as the detected signal Vout[m] or the reference signal Vrf which is supplied to the detection circuit 20 via the internal wire LHs2 as illustrated in FIG. 6 is referred to as a signal Out2. In addition, hereinafter, for convenience of explanation, a connection portion (refer to FIG. 12) between the internal wire LHs1 and the detection circuit 20 is referred to as a connection node TN1 and a connection portion between the internal wire LHs2 and the detection circuit 20 is referred to as a connection node TN2.

Although the details will be described below, in a case where the discharging unit D[m1] belonging to the group GL1 is selected as the determination target discharging unit D-H, the detected signal Vout[m1] is supplied to the detection circuit 20 via the internal wire LHs1 as the signal Out1 and the reference signal Vrf is supplied to the detection circuit 20 via the internal wire LHs2 as the signal Out2. On the other hand in a case where the discharging unit D[m2] belonging to the group GL2 is selected as the determination target discharging unit D-H, the reference signal Vrf is supplied to the detection circuit 20 via the internal wire LHs1 as the signal Out1 and the detected signal Vout[m2] is supplied to the detection circuit 20 via the internal wire LHs2 as the signal Out2.

Here, regarding the internal wire LHs1, the internal wire LHs2, and the internal wire LHa, it is preferable that an interval between the internal wires, the length of an area, in which the internal wires are arranged with an interval having a predetermined length or lower, or the like be adjusted so that a capacity value of parasitic capacitance CS1 between the internal wire LHs1 and the internal wire LHa and a capacity value of parasitic capacitance CS2 between the internal wire LHs2 and the internal wire LHa become approximately the same as each other. In the specification, "approximately the same" is a concept including a case where two or more values can be regarded identical when the error is not considered.

As described above, the driving signal Com-A with large amplitude is supplied to the internal wire LHa. On the other hand, the detected signal Vout[m] which is transmitted to the detection circuit 20 via the internal wire LHs 1 or the LHs2 is a signal with small amplitude. Therefore, a change in potential of the driving signal Com-A may be superimposed on the detected signal Vout as noise through the parasitic capacitance CS1 or the parasitic capacitance CS2. In this case, if the discharge state determination circuit 9 executes the discharge state determination on the basis of the residual vibration signal NSA generated using the detected signal Vout on which the noise is superimposed, the accuracy of the determination may be low.

On the other hand, in the first embodiment, the residual vibration signal NSA is generated on the basis of the detected signal Vout and the reference signal Vrf. The noise due to a change in potential of the driving signal Com-A is superimposed on the reference signal Vrf as with the detected signal Vout. Accordingly, it is possible to decrease or cancel out the noise component superimposed on the detected signal Vout using the reference signal Vrf. Therefore, in the first embodiment, it is possible to generate the residual vibration signal NSA on the basis of a signal which is obtained by decreasing the noise components superimposed on the detected signal Vout using the reference signal Vrf. Accordingly, in the first embodiment, it is possible to maintain the favorable accuracy in the discharge state determination.

4. Operation of Head Unit

Hereinafter, the operation of each head unit HU will be described with reference to FIGS. 7 to 9B.

In the first embodiment, an operation period of the ink jet printer 1 includes one or a plurality of unit periods Tu. For each unit period Tu, the ink jet printer 1 according to the first embodiment can perform one or both of an operation of driving each discharging unit D in the printing process and an operation of driving the determination target discharging unit D-H and detecting the residual vibration in the discharge state determination process. That is, in the first embodiment, it is assumed that the printing process and the discharge state determination process can be executed within the same unit period Tu.

In addition, generally, the ink jet printer 1 forms an image indicated by the printing data Img by repeatedly executing the printing process over a plurality of consecutive or intermittent unit periods Tu so as to discharge ink one time or a plurality of times from each discharging unit D. In addition, the ink jet printer 1 according to the first embodiment executes the discharge state determination process in which each of the M discharging units D[1] to D[M] is set as the determination target discharging unit D-H by executing the discharge state determination process M times over consecutive or intermittent M unit periods Tu.

Figure 7:
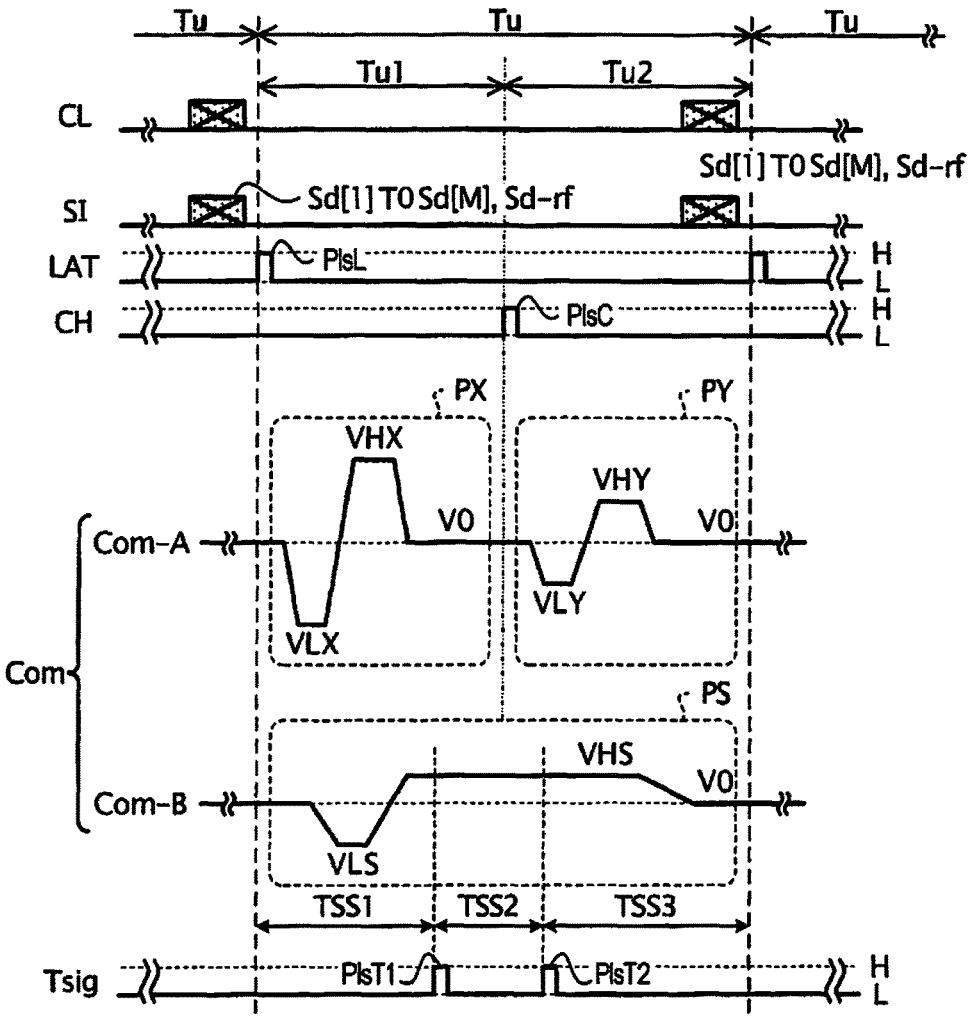
FIG. 7 is a timing chart for explaining a printing process and a discharge state determination process.

FIG. 7 is a timing chart for explaining the operation of the ink jet printer 1 in the unit period Tu.

As illustrated in FIG. 7, the controller 6 outputs the latch signal LAT having a pulse PlsL and the change signal CH having a pulse PlsC. Using these signals, the controller 6 defines the unit period Tu as a period from rise-up of a pulse PlsL to rise-up of the next pulse PlsL. The controller 6 divides the unit period Tu into two control periods Tu1 and Tu2 using the pulse PlsC.

The controller 6 according to the first embodiment can incorporate an individual specifying signal Sd[m] for specifying the driving mode of the discharging unit D[m] in each unit period Tu, an individual specifying signal Sd-rf for specifying the operation of the switches SWrf1 and SWrf2 in each unit period Tu, into the printing signal SI. In a case where at least one of the printing process and the discharge state determination process is executed in the unit period Tu, as illustrated in FIG. 7, the controller 6 supplies the printing signal SI, which includes the individual specifying signals Sd[1] to Sd[M] and the individual specifying signal Sd-rf, to the connection state specifying circuit 11 before start of the unit period Tu with the printing signal SI synchronized with a clock signal CL. In this case, the connection state specifying circuit 11 generates connection state specifying signals SLa[m], SLb[m], SLs[m], SL-rf1, and SL-rf2 on the basis of the individual specifying signals Sd[1] to Sd[m] and the individual specifying signal Sd-rf within the unit period Tu.

The individual specifying signal Sd[m] according to the first embodiment is a signal for specifying any one of five driving modes of: a driving mode in which an amount of ink corresponding to a large dot (large amount of ink) is discharged (may be referred to as "formation of large dot"); a driving mode in which an amount of ink corresponding to a medium dot (medium amount of ink) is discharged (may be referred to as "formation of medium dot"); a driving mode in which an amount of ink corresponding to a small dot (small amount of ink) is discharged (may be referred to as "formation of small dot"); a driving mode in which ink is not discharged; and a driving mode in which the discharging unit D is driven as a determination target of the discharge state determination process (may be referred to as "driving of the discharging unit D as the determination target discharging unit D-H"), with respect to the discharging unit D[m] in each unit period Tu.

The individual specifying signal Sd-rf is a signal for specifying any one of three operation modes of: an operation mode for the case of detecting the detected signal Vout[m1] from the discharging unit D[m1] belonging to the group GL1 (may be referred to as "first detecting operation"); an operation mode for the case of detecting the detected signal Vout[m2] from the discharging unit D[m2] belonging to the group GL2 (may be referred to as "second detecting operation"); and an operation mode for the case of not detecting the detected signal Vout from the discharging units D[1] to D[M] (may be referred to as "third detecting operation"), with respect to the switches SWrf1 and SWrf2 in each unit period Tu.

Note that, in the first embodiment, it is assumed that the individual specifying signal Sd[m] and the individual specifying signal Sd-rf are 3-bit digital signals, for example (refer to FIGS. 11A and 11B).

As illustrated in FIG. 7, the controller 6 outputs the driving signal Com-A having a waveform PX set for the control period Tu1 and a waveform PY set for the control period Tu2. In the first embodiment, the waveform PX and the waveform PY are determined such that the potential difference between the highest potential VHX and the lowest potential VLX of the waveform PX becomes larger than the potential difference between the highest potential VHY and the lowest potential VLY of the waveform PY. Specifically, the waveform PX is determined such that a medium amount of ink is discharged from the discharging unit D[m] in a case where the discharging unit D[m] is driven using the driving signal Com-A having the waveform PX. In addition, the waveform PY is determined such that a small amount of ink is discharged from the discharging unit D[m] in a case where the discharging unit D[m] is driven using the driving signal Com-A having the waveform PY. Note that, potentials of the waveform PX and the waveform PY at the time of the start and end are set to the reference potential V0.

In a case where the individual specifying signal Sd[m] specifies formation of a large dot with respect to the discharging unit D[m], the connection state specifying circuit 11 sets the connection state specifying signal SLa[m] to be at the high level for the control periods Tu1 and Tu2, and sets the connection state specifying signals SLb[m] and SLs[m] to be at the low level for the unit period Tu. In this case, the discharging unit D[m] is driven by the driving signal Com-A having the waveform PX in the control period Tu1, and discharges a medium amount of ink. In addition, the discharging unit D[m] is driven by the driving signal Com-A having the waveform PY in the control period Tu2, and discharges a small amount of ink. Therefore, the discharging unit D[m] discharges a large amount of ink in total in the unit period Tu, and a large dot is formed on the recording medium P.

In addition, in a case where the individual specifying signal Sd[m] specifies formation of a medium dot with respect to the discharging unit D[m], the connection state specifying circuit 11 sets the connection state specifying signal SLa[m] to be at the high level for the control period Tu1, and to be at the low level for the control period Tu2, respectively, and sets the connection state specifying signals SLb[m] and SLs[m] to be at the low level for the unit period Tu. In this case, the discharging unit D[m] discharges a medium amount of ink in the unit period Tu, and a medium dot is formed on the recording medium P.

In addition, in a case where the individual specifying signal Sd[m] specifies formation of a small dot with respect to the discharging unit D[m], the connection state specifying circuit 11 sets the connection state specifying signal SLa[m] to be at the low level for the control period Tu1, and to be at the high level for the control period Tu2, respectively, and sets the connection state specifying signals SLb[m] and SLs[m] to be at the low level for the unit period Tu. In this case, the discharging unit D[m] discharges a small amount of ink in the unit period Tu, and a small dot is formed on the recording medium P.

In addition, in a case where the individual specifying signal Sd[m] specifies non-discharge of ink with respect to the discharging unit D[m], the connection state specifying circuit 11 sets the connection state specifying signals SLa[m], SLb[m] and SLs[m] to be at the low level for the unit period Tu. In this case, the discharging unit D[m] does not discharge ink in the unit period Tu, and no dot is formed on the recording medium P.

As illustrated in FIG. 7, the controller 6 outputs the driving signal Com-B having a waveform PS set for the unit period Tu. In the first embodiment, the waveform PS is determined such that a potential difference between the highest potential VHS and the lowest potential VLS of the waveform PS becomes lower than the potential difference between the highest potential VHY and the lowest potential VLY of the waveform PY. Specifically, the waveform PS is determined such that the discharging unit D[m] is driven but no ink is discharged from the discharging unit D[m] in a case where the driving signal Com-B having the waveform PS is supplied to the discharging unit D[m]. Note that, potentials of the waveform PS at the time of the start and end are set to the reference potential V0.

The controller 6 outputs a period specifying signal Tsig having a pulse PlsT1 and a pulse PlsT2. The controller 6 divides the unit period Tu into a control period TSS1 which is defined by the pulse PlsL and the pulse PlsT1, a control period TSS2 which is defined by the pulse PlsT1 and the pulse PlsT2 and a control period TSS3 which is defined by the pulse PlsT2 and the next pulse PlsL.

In addition, in a case where the individual specifying signal Sd[m] specifies the discharging unit D[m] as the determination target discharging unit D-H, the connection state specifying circuit 11 sets the connection state specifying signal SLa[m] to be at the low level for the unit period Tu, sets the connection state specifying signal SLb[m] to be at the low level for the control periods TSS1 and TSS3 and to be at the high level for the control period TSS2, respectively, and sets the connection state specifying signal SLs[m] to be at the low level for the control periods TSS1 and TSS3 and to be at the high level for the control period TSS2, respectively.

In this case, the determination target discharging unit D-H is driven by the driving signal Com-B having the waveform PS in the control period TSS1. Specifically, the piezoelectric element PZ of the determination target discharging unit D-H is displaced by the driving signal Com-B having the waveform PS in the control period TSS1. As a result of this, vibration is generated in the determination target discharging unit D-H, and the vibration remains for the control period TSS2. In addition, in the control period TSS2, the potential of the upper electrode Zu included in the piezoelectric element PZ of the determination target discharging unit D-H is changed according to the residual vibration generated in the determination target discharging unit D-H. In other words, in the control period TSS2, the upper electrode Zu included in the piezoelectric element PZ of the determination target discharging unit D-H exhibits a potential according to an electromotive force of the piezoelectric element PZ that depends on the residual vibration generated in the determination target discharging unit D-H. In addition, in the control period TSS2, the potential of the upper electrode Zu can be detected as the detected signal Vout.

In a case where the discharging unit D[m1] belonging to the group GL1 is specified as the determination target discharging unit D-H, the controller 6 specifies the first detecting operation with respect to the switches SWrf1 and SWrf2 using the individual specifying signal Sd-rf. In a case where the individual specifying signal Sd-rf specifies the first detecting operation, the connection state specifying circuit 11 sets the connection state specifying signal SL-rf1 to be at the low level for the unit period Tu, and sets the connection state specifying signal SL-rf2 to be at the low level for the control periods TSS1 and TSS3 and to be at the high level for the control period TSS2, respectively.

In a case where the discharging unit D[m2] belonging to the group GL2 is specified as the determination target discharging unit D-H, the controller 6 specifies the second detecting operation with respect to the switches SWrf1 and SWrf2 using the individual specifying signal Sd-rf. In a case where the individual specifying signal Sd-rf specifies the second detecting operation, the connection state specifying circuit 11 sets the connection state specifying signal SL-rf1 to be at the low level for the control periods TSS1 and TSS3 and to be at the high level for the control period TSS2, respectively, and sets the connection state specifying signal SL-rf2 to be at the low level for the unit period Tu.

In a case where all of the discharging units D[1] to D[M] are not specified as the determination target discharging unit D-H, the controller 6 specifies the third detecting operation with respect to the switches SWrf1 and SWrf2 using the individual specifying signal Sd-rf. In a case where the individual specifying signal Sd-rf specifies the third detecting operation, the connection state specifying circuit 11 sets the connection state specifying signals SL-rf1 and SL-rf2 to be at the low level for the unit period Tu.

Figure 8A:
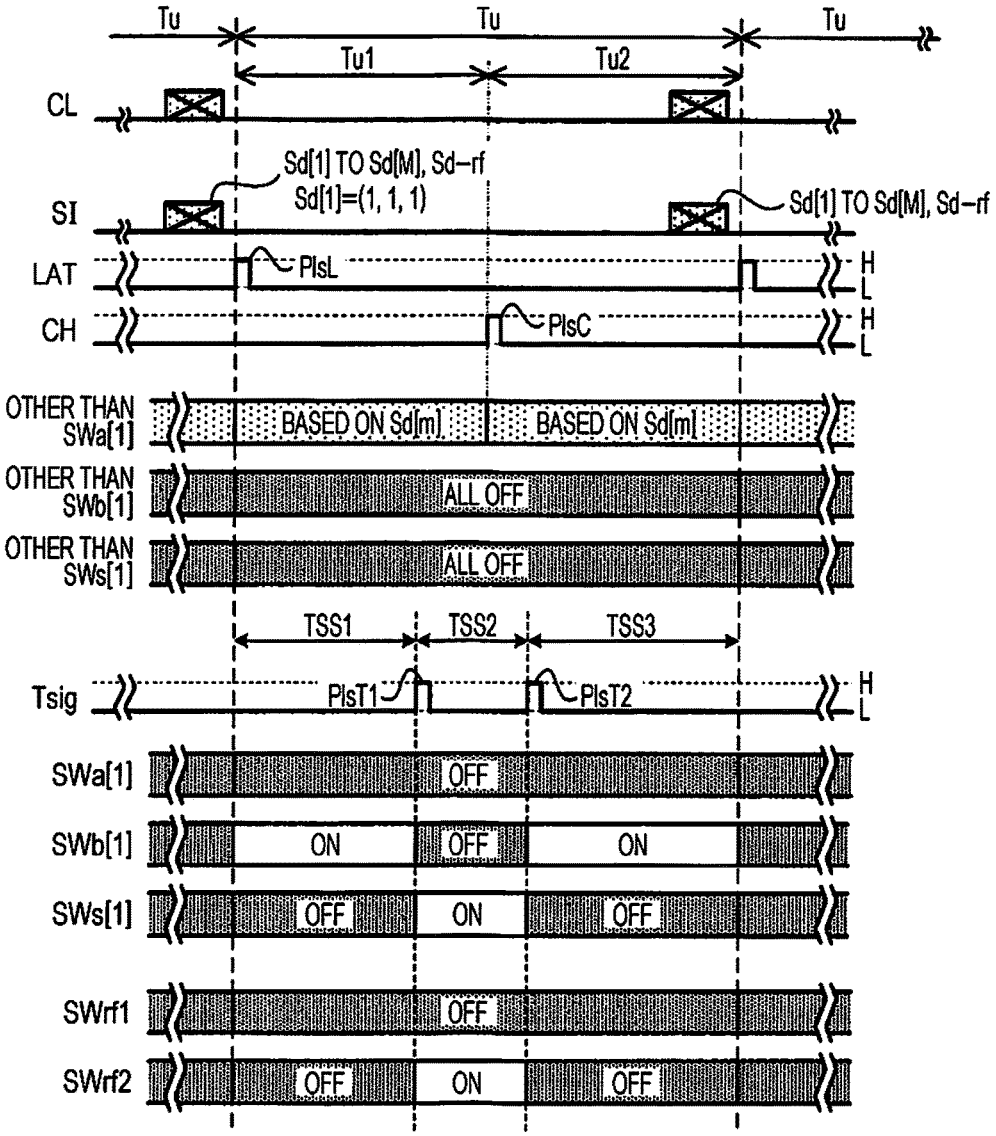
FIG. 8A is a timing chart for explaining the printing process and the discharge state determination process.
Figure 9A:
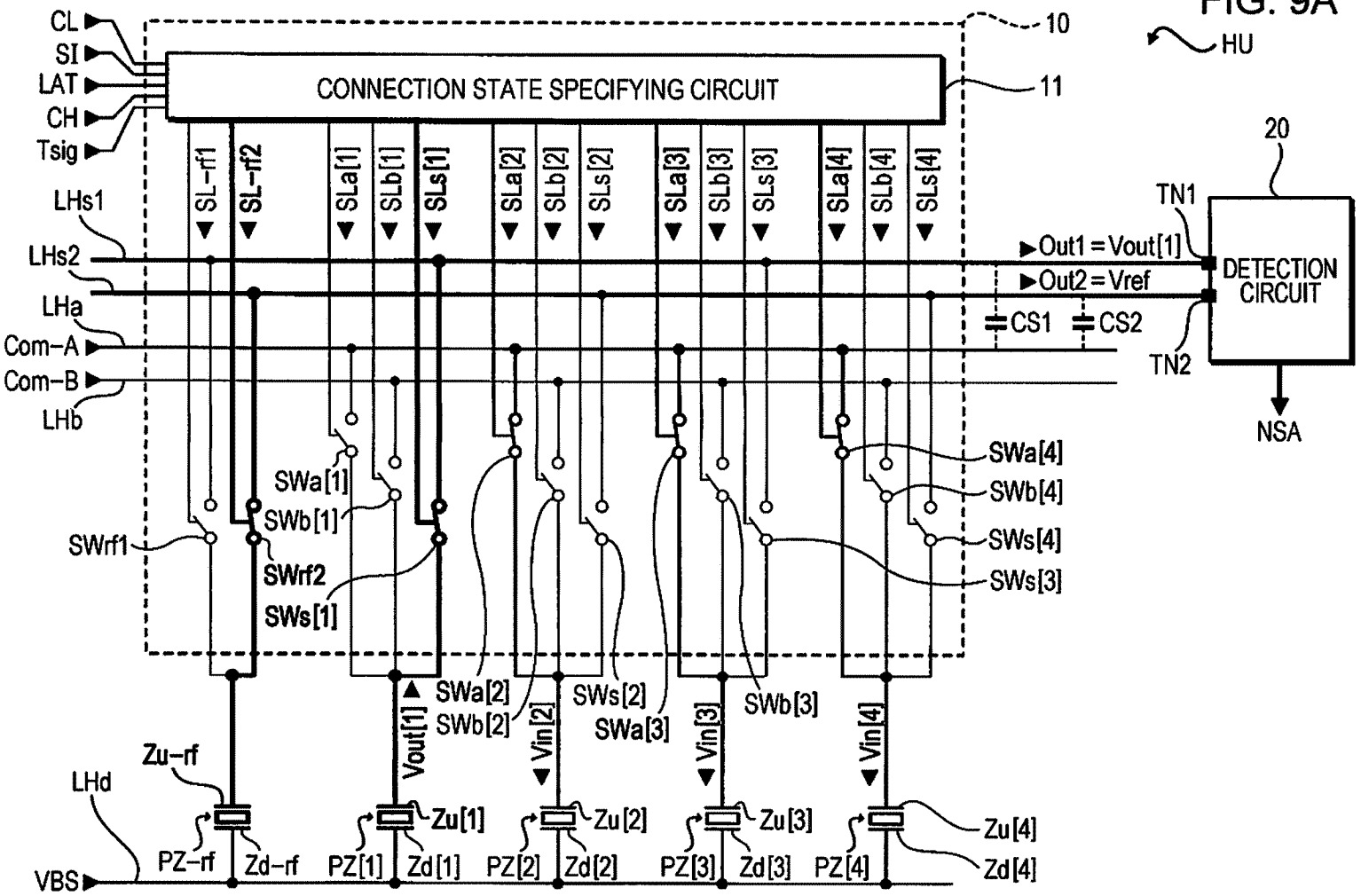
FIG. 9A is a timing chart for explaining the printing process and the discharge state determination process.

FIGS. 8A and 9A are diagrams for explaining the operation of the switching circuit 10 by using a case where the discharging unit D[m1] belonging to the group GL1, for example, the discharging unit D[1] is specified as the determination target discharging unit D-H for the unit period Tu, as an example.

As illustrated in FIG. 8A, in the unit period Tu in which discharging unit D[1] is specified as the determination target discharging unit D-H, the switch SWa[1] is turned off for the unit period Tu, the switch SWb[1] is turned on for the control periods TSS1 and TSS3, the switch SWs[1] is turned on for the control period TSS2, the switch SWrf1 is turned off for the unit period Tu, and the switch SWrf2 is turned on for the control period TSS2.

In this case, in the control period TSS1, the piezoelectric element PZ[1] is driven by the driving signal Com-B and is displaced, and in the control period TSS2, there is residual vibration remaining in the discharging unit D[1]. In addition, as illustrated in FIG. 9A, in the control period TSS2, the detected signal Vout[1] based on the residual vibration in the discharging unit D[1] is supplied from the upper electrode Zu[1] to the connection node TN1 as the signal Out1 via the internal wire LHs1, and the reference signal Vrf indicating the potential of the upper electrode Zu-rf of the reference unit D-rf is supplied to the connection node TN2 as the signal Out2 via the internal wire LHs2.

In a case as in FIGS. 8A and 9A, the discharging units D[2], D[3], and D[4] excluding the discharging unit D[1] selected as the determination target discharging unit D-H are driven according to the individual specifying signal Sd and are used for the printing processing.

Figure 8B:
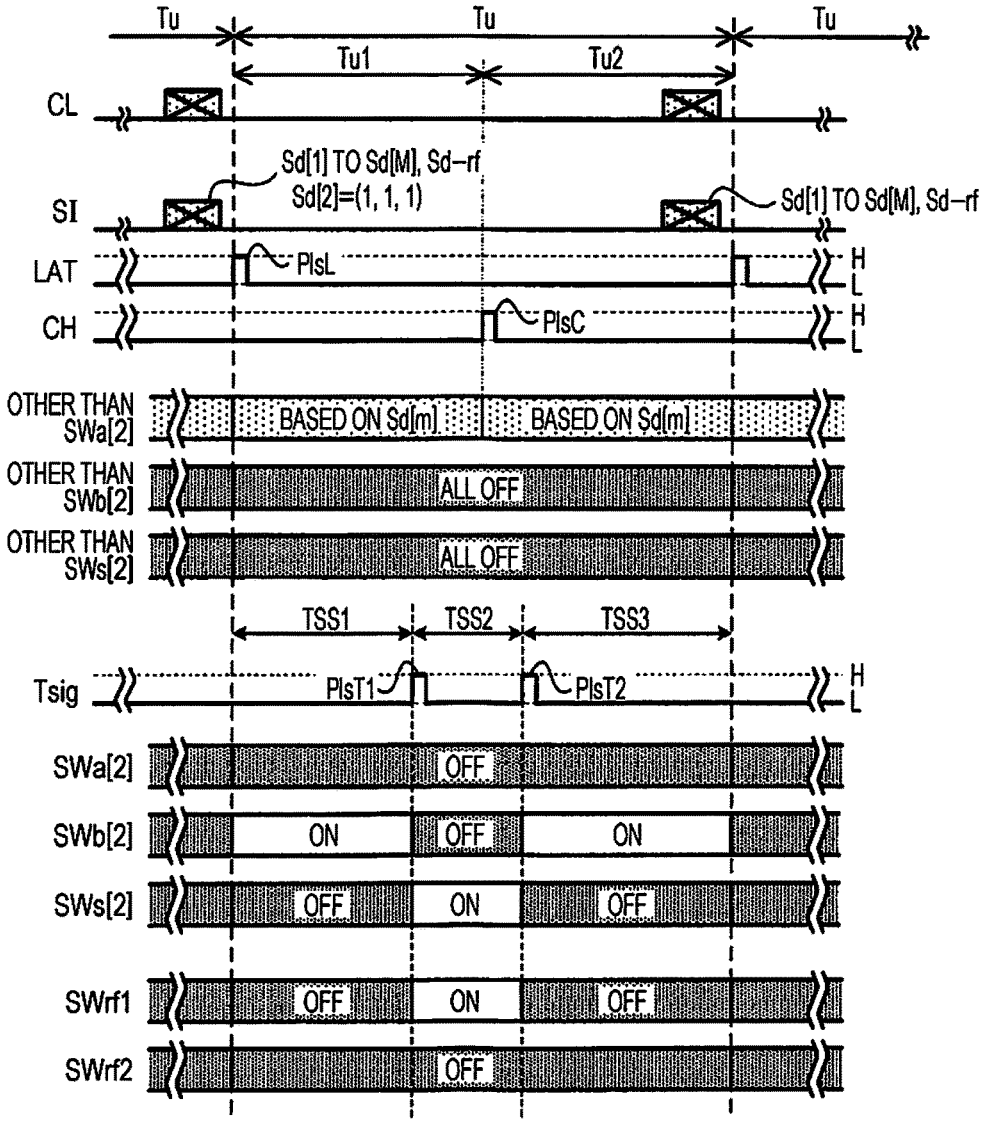
FIG. 8B is a timing chart for explaining the printing process and the discharge state determination process.
Figure 9B:
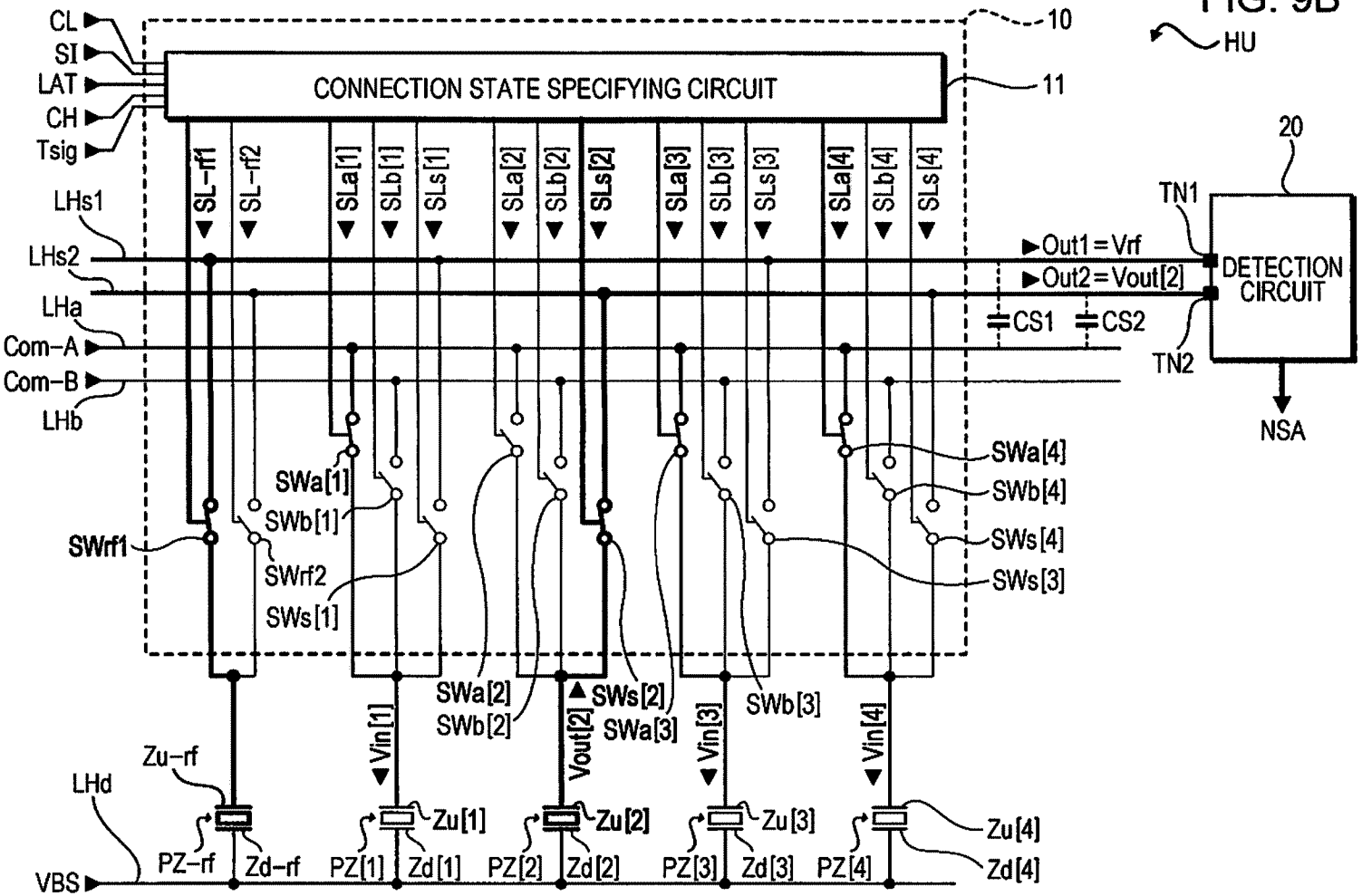
FIG. 9B is a timing chart for explaining the printing process and the discharge state determination process.

FIGS. 8B and 9B are diagrams for explaining the operation of the switching circuit 10 by using a case where the discharging unit D[m2] belonging to the group GL2, for example, the discharging unit D[2] is specified as the determination target discharging unit D-H for the unit period Tu, as an example.

As illustrated in FIG. 8B, in the unit period Tu in which discharging unit D[2] is specified as the determination target discharging unit D-H, the switch SWa[2] is turned off for the unit period Tu, the switch SWb[2] is turned on for the control periods TSS1 and TSS3, the switch SWs[2] is turned on for the control period TSS2, the switch SWrf1 is turned on for the control period TSS2, and the switch SWrf2 is turned off for the unit period Tu.

In this case, in the control period TSS1, the piezoelectric element PZ[2] is driven by the driving signal Com-B and is displaced, and in the control period TSS2, there is residual vibration remaining in the discharging unit D[2]. In addition, as illustrated in FIG. 9B, in the control period TSS2, the detected signal Vout[2] based on the residual vibration in the discharging unit D[2] is supplied from the upper electrode Zu[2] to the connection node TN2 as the signal Out2 via the internal wire LHs2, and the reference signal Vrf indicating the potential of the upper electrode Zu-rf of the reference unit D-rf is supplied to the connection node TN1 as the signal Out1 via the internal wire LHs1.

In a case as in FIGS. 8B and 9B, the discharging units D[1], D[3], and D[4] excluding the discharging unit D[2] selected as the determination target discharging unit D-H are driven according to the individual specifying signal Sd and are used for the printing processing.

As described above, according to the first embodiment, there is a case where the printing process and the discharge state determination process are executed at the same time, in the unit period Tu. In this case, when the discharging unit D[m] is selected as the determination target discharging unit D-H in a case where the discharging unit D[m] needs to discharge ink for forming an image based on the printing data Img, a dot necessary for forming an image based on the printing data Img is not formed, which causes a decrease in image quality. Therefore, the controller 6 according to the first embodiment selects the determination target discharging unit D-H from the discharging units D which do not need to discharge ink in the printing process. That is, in a case where it is assumed that the discharge state determination process is not executed, the controller 6 selects the determination target discharging unit D-H from the discharging units D which are scheduled to discharge no ink in the printing process.

5. Connection State Specifying Circuit

Next, the configuration and the operation of the connection state specifying circuit 11 will be described with reference to FIGS. 10 to 11B.

Figure 10:
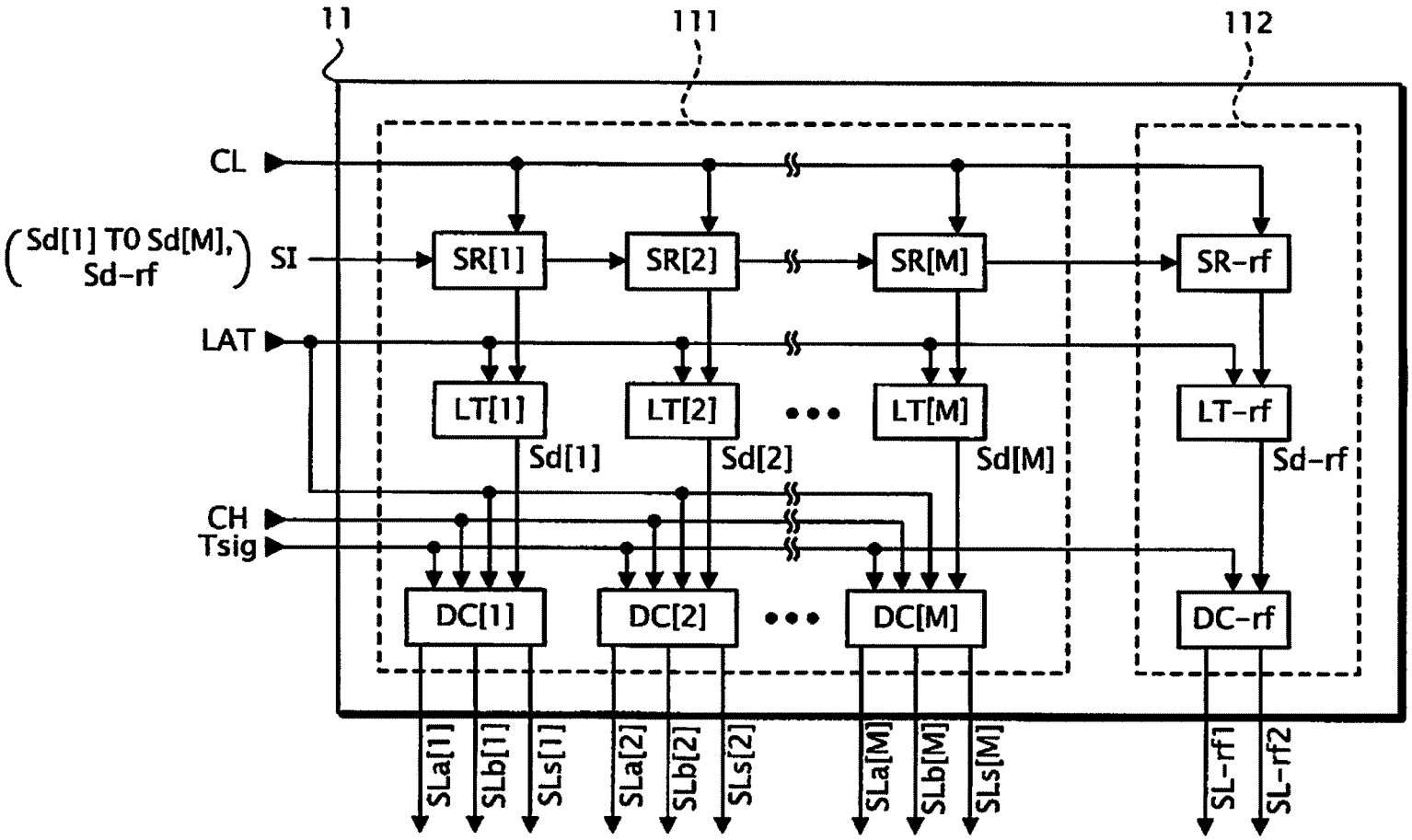
FIG. 10 is a block diagram illustrating a configuration of a connection state specifying' circuit.

FIG. 10 is a diagram illustrating a configuration example of the connection state specifying circuit 11 according to the first embodiment. As illustrated in FIG. 10, the connection state specifying circuit 11 includes a specifying signal generation circuit 111 which generates the connection state specifying signals SLa[1] to SLa[M], SLb[1] to SLb[M], and SLs[1] to SLs[M] and a specifying signal generation circuit 112 which generates the connection state specifying signals SL-rf1 and SL-rf2.

As illustrated in FIG. 10, the specifying signal generation circuit 111 includes transmission circuits SR[1] to SR[M], latch circuits LT[1] to LT[M], and decoders DC[1] to DC[M], which respectively correspond to the discharging units D[1] to D[M].

The individual specifying signal Sd[m] is supplied to the transmission circuit SR[m]. Note that, FIG. 10 illustrates a case where the individual specifying signals Sd[1] to Sd[M] are supplied in serial, and, for example, the individual specifying signal Sd[m] corresponding to the mth-stage discharging unit is transmitted to the transmission circuit SR[m] via the transmission circuit SR[1] being synchronized with the clock signal CL.

The latch circuit LT[m] latches the individual specifying signal Sd[m] which is supplied to the transmission circuit SR[m] when a pulse PlsL of the latch signal LAT rises up to the high level.

The decoder DC[m] generates connection state specifying signals SLa[m], SLb[m], and SLs[m] on the basis of the individual specifying signal Sd[m], the latch signal LAT, the change signal CH, and the period specifying signal Tsig.

FIG. 11A is a diagram for explaining generation of the connection state specifying signals SLa[m], SLb[m], and SLs[m] in the decoder DC[m]. The decoder DC[m] decodes the individual specifying signal Sd[m] and generates the connection state specifying signals SLa[m], SLb[m], and SLs[m] as in FIG. 11A.

As illustrated in FIG. 11A, the individual specifying signal Sd[m] according to the first embodiment indicates any one of a value (1, 1, 0) for specifying formation of a large dot, a value (1, 0, 0) for specifying formation of a medium dot, a value (0, 1, 0) for specifying formation of a small dot, a value (0, 0, 0) for specifying non-discharge of ink, and a value (1, 1, 1) for specifying driving of the discharging unit D as the determination target discharging unit D-H. In addition, in a case where the individual specifying signal Sd[m] indicates (1, 1, 0), the decoder DC[m] sets the connection state specifying signal SLa[m] to be at the high level for the control periods Tu1 and Tu2, in a case where the individual specifying signal Sd[m] indicates (1, 0, 0), the decoder DC[m] sets the connection state specifying signal SLa[m] to be at the high level for the control period Tu1, in a case where the individual specifying signal Sd[m] indicates (0, 1, 0), the decoder DC[m] sets the connection state specifying signal SLa[m] to be at the high level for the control period Tu2, in a case where the individual specifying signal Sd[m] indicates (1, 1, 1), the decoder DC[m] sets the connection state specifying signal SLb[m] to be at the high level for the control periods TSS1 and TSS3, sets the connection state specifying signal SLa[m] to be at the high level for the control period TSS2, and in a case where any one of the above conditions are not satisfied, the decoder DC[m] sets each signal to be at the low level.

As illustrated in FIG. 10, the specifying signal generation circuit 112 includes a transmission circuit SR-rf, a latch circuit LT-rf, and a decoder DC-rf. The individual specifying signal Sd-rf is supplied to the transmission circuit SR-rf. The latch circuit LT-rf latches the individual specifying signal Sd-rf which is supplied to the transmission circuit SR-rf when a pulse PlsL of the latch signal LAT rises up to the high level. The decoder DC-rf generates connection state specifying signals SL-rf1 and SL-rf2 on the basis of the individual specifying signal Sd-rf and the period specifying signal Tsig.

FIG. 11B is a diagram for explaining generation of the connection state specifying signals SL-rf1 and SL-rf2 in the decoder DC-rf. The decoder DC-rf decodes the individual specifying signal Sd-rf and generates the connection state specifying signals SL-rf1 and SL-rf2 as in FIG. 11B.

As illustrated in FIG. 11B, the individual specifying signal Sd-rf according to the first embodiment indicates any one of a value (1, 0, 1) for specifying the first detecting operation, a value (0, 1, 1) for specifying the second detecting operation, and a value (0, 0, 1) for specifying the third detecting operation. In addition, in a case where the individual specifying signal Sd-rf indicates (1, 0, 1), the decoder DC-rf sets the connection state specifying signal SL-rf2 to be at the high level for the control period TSS2, in a case where the individual specifying signal Sd-rf indicates (0, 1, 1), the decoder DC-rf sets the connection state specifying signal SL-rf1 to be at the high level for the control period TSS2, and in a case where any one of the above conditions are not satisfied, the decoder DC-rf sets each signal to be at the low level.

6. Detection Circuit

Next, the configuration and operation of the detection circuit 20 will be described with reference to FIG. 12.

Figure 12:
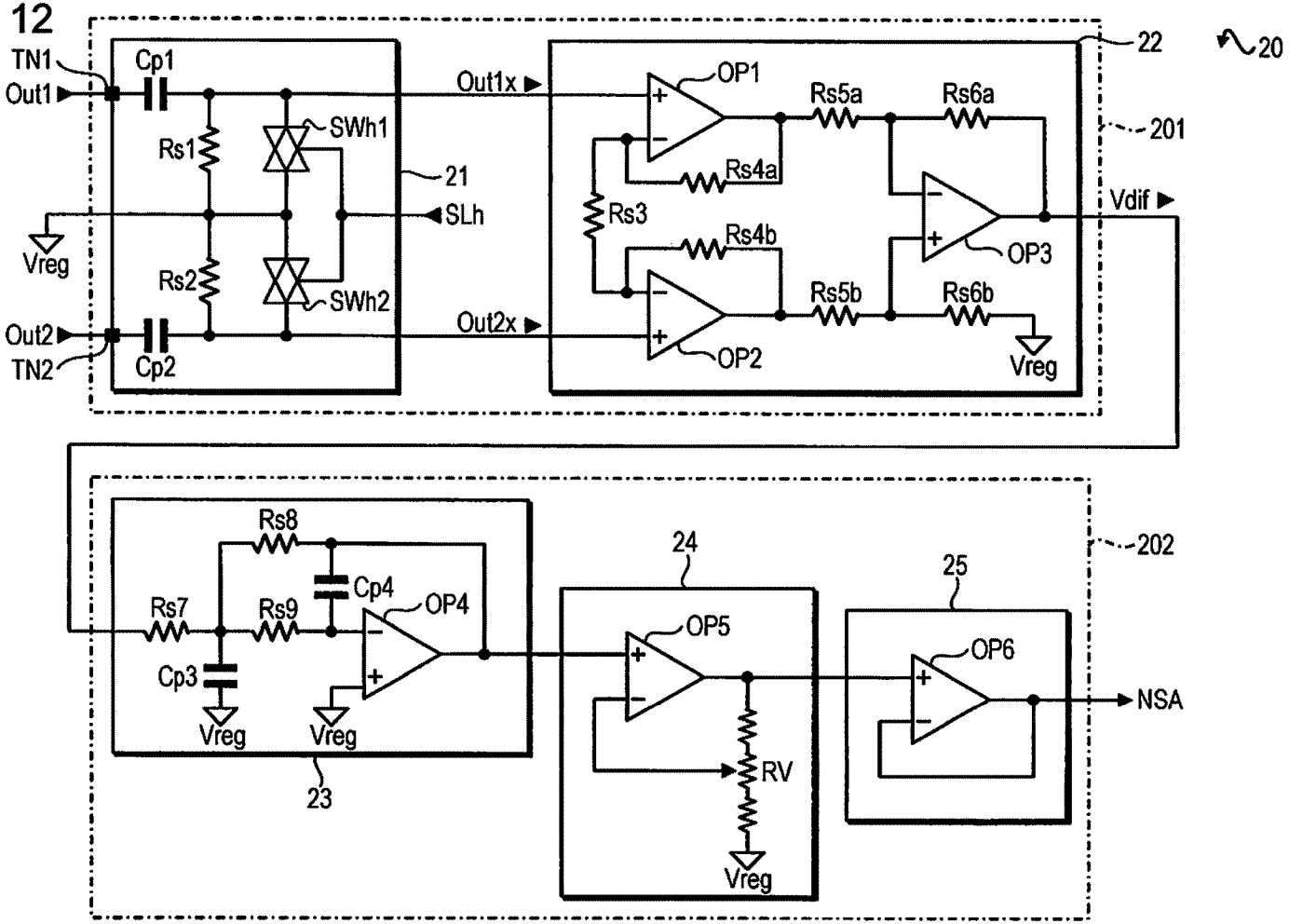
FIG. 12 is a block diagram illustrating a configuration of a detection circuit.

FIG. 12 is a diagram illustrating a configuration example of the detection circuit 20 according to the first embodiment. As illustrated in FIG. 12, the detection circuit 20 includes a difference signal generation circuit 201 which generates a difference signal Vdif indicating a difference between a potential indicated by the signal Out1 and a potential indicated by the signal Out2, and a waveform shaping circuit 202 which adjusts the amplitude of the difference signal Vdif and generates the residual vibration signal NSA by eliminating a noise component in the difference signal Vdif.

As illustrated in FIG. 12, the difference signal generation circuit 201 includes a high pass filter 21 and a differential amplification circuit 22. The difference signal generation circuit 201 generates the difference signal Vdif on the basis of the signal Out1 and the signal Out2.

The high pass filter 21 includes a capacitor Cp1, a resistor Rs1, a switch SWh1, a capacitor Cp2, a resistor Rs2, and a switch SWh2. One electrode of the capacitor Cp1 is electrically connected to the connection node TN1. One end of the resistor Rs1 is electrically connected to the other electrode of the capacitor Cp1. One end of the switch SWh1 is electrically connected to the other electrode of the capacitor Cp1. One electrode of the capacitor Cp2 is electrically connected to the connection node TN2. One end of the resistor Rs2 is electrically connected to the other electrode of the capacitor Cp2. One end of the switch SWh2 is electrically connected to the other electrode of the capacitor Cp2. In addition, the other end of the resistor Rs1, the other end of the switch SWh1, the other end of the resistor Rs2, and the other end of the switch SWh2 are electrically connected to the power supplying line set to have a constant potential Vreg. Note that, FIG. 12 illustrates a case where transmission gates are used as the switches SWh1 and SWh2.

The controller 6 supplies a connection state specifying signal SLh to the switches SWh1 and SWh2 so that the switches SWh1 and SWh2 are turned off in the detection period which is at least a portion of the control period TSS2 and the switches SWh1 and SWh2 are turned on in the unit period Tu except for the detection period. Therefore, the high pass filter 21 outputs a signal Out1*x* which is obtained by eliminating a DC component of the signal Out1 using the capacitor Cp1 and a signal Out2*x* which is obtained by eliminating a DC component of the signal Out2 using the capacitor Cp1 in the detection period included in the control period TSS2.

In the first embodiment, the detection period is defined such that the detection period starts after the start of the control period TSS2 and the detection period ends before the end of the control period TSS2. When the detection period is set to be shorter than the control period TSS2 as in the first embodiment, a change in potential of the internal wires LHs1 and LHs2 at the start and end of the control period TSS2 is not likely to influence the detection circuit 20. However, the invention is not limited to such an embodiment, and the detection period and the control period TSS2 may be coincident with each other.

The differential amplification circuit 22 includes operational amplifiers OP1, OP2, and OP3, a resistor Rs3 having a resistance value r3, resistors Rs4*a* and Rs4*b* having a resistance value r4, resistors Rs5*a* and Rs5*b* having a resistance value r5, and resistors Rs6*a* and Rs6*b* having a resistance value r6. The differential amplification circuit 22 is an instrumentation amplifier, and outputs the difference signal Vdif having a signal level represented by the following expression (1). In the expression (1), symbols representing the signals are used to indicate a signal level of each signal.

$$Vdif=(r6/r5)\times\{1+2\times(r4/r3)\}\times(Out1-Out2) \quad (1)$$

Since the common-mode rejection ratio of the differential amplification circuit 22 is high, even when a common mode noise is mixed into the internal wires LHs1 and LHs2, the differential amplification circuit 22 can generate the difference signal Vdif from which the common mode noise is eliminated. That is, in the difference signal generation circuit 201, it is possible to cancel out a noise superimposed on the detected signal Vout which is supplied as one of the signal Out1 and the signal Out2, using a noise superimposed on the reference signal Vrf which is supplied as the other of the signal Out1 and the signal Out2.

As illustrated in FIG. 12, the waveform shaping circuit 202 includes a low pass filter 23, a gain adjustment circuit 24, and a buffer 25 and the waveform shaping circuit 202 generates the residual vibration signal NSA on the basis of the difference signal Vdif.

The low pass filter 23 includes an operational amplifier OP4, resistors Rs7, Rs8, and Rs9, and capacitors Cp3 and Cp4. The low pass filter 23 eliminates a noise mixed in the difference signal Vdif by attenuating a high-frequency component in the difference signal Vdif.

The gain adjustment circuit 24 is a negative feedback amplifier that includes an operational amplifier OP5 and a variable resistor RV, and it is possible to adjust the amplitude of a signal output from the gain adjustment circuit 24 by adjusting the resistance value of the variable resistor RV.

The buffer 25 is a voltage follower configured using an operational amplifier OP6, and the buffer 25 outputs the residual vibration signal NSA after converting the impedance of a signal output from the gain adjustment circuit 24.

As described above, the detection circuit 20 generates the difference signal Vdif indicating the difference between the detected signal Vout and the reference signal Vrf on the basis of the signal Out1 and the signal Out2, and generates the residual vibration signal NSA by amplifying the difference signal Vdif or the like.

7. Discharge State Determination Circuit

Next, the discharge state determination circuit 9 will be described with reference to FIGS. 13 and 14.

Generally, the residual vibration generated in the discharging unit D has a natural vibration frequency which is determined by the shape of the nozzle N, the weight of ink filling the cavity 320, the viscosity of ink filling the cavity 320, and the like.

In addition, generally, in a case where there is a discharge abnormality in the discharging unit D due to bubbles intruding into the cavity 320 of the discharging unit D, the frequency of the residual vibration becomes high in comparison with a case where there is no bubble intruding into the cavity 320. In addition, generally, in a case where there is a discharge abnormality in the discharging unit D due to foreign substances attached to the vicinity of the nozzle N of the discharging unit D, the frequency of the residual vibration becomes low in comparison with a case where there is no foreign substance attached to the vicinity of the nozzle N. In addition, generally, in a case where there is a discharge abnormality in the discharging unit D due to an increase in viscosity of ink filling the cavity 320 of the discharging unit D, the frequency of the residual vibration becomes low in comparison with a case where there is no increase in viscosity of ink filling the cavity 320. In addition, generally, in a case where there is a discharge abnormality in the discharging unit D due to an increase in viscosity of ink filling the cavity 320 of the discharging unit D, the frequency of the residual vibration becomes low in comparison with a case where there are foreign substances such as paper dust attached to the vicinity of the nozzle N of the discharging unit D. In addition, generally, in a case where there is a discharge abnormality in the discharging unit D since there is no ink filling the cavity 320 of the discharging unit D or in a case where there is a discharge abnormality in the discharging unit D since the piezoelectric element PZ cannot be displaced due to the failure of the piezoelectric element PZ, the amplitude of the residual vibration becomes small.

As described above, the residual vibration signal NSA exhibits a waveform according to the residual vibration generated in the determination target discharging unit D-H. Specifically, the residual vibration signal NSA exhibits a frequency according to the frequency of the residual vibration generated in the determination target discharging unit D-H, and exhibits a frequency according to the amplitude of the residual vibration generated in the determination target discharging unit D-H. Therefore, the discharge state determination circuit 9 can perform the discharge state determination of determining the ink discharge state of the determination target discharging unit D-H, on the basis of the residual vibration signal NSA.

The discharge state determination circuit 9 generates period information Info-T that indicates a time length NTc of one period of the residual vibration signal NSA and generates amplitude information Info-S that indicates whether or not the amplitude of the residual vibration signal NSA is a predetermined amplitude. Next, the discharge state determination circuit 9 generates the determination result signal Stt that indicates the result of the ink discharge state determination of the determination target discharging unit D-H, on the basis of the period information Info-T and the amplitude information Info-S.

Figure 13:
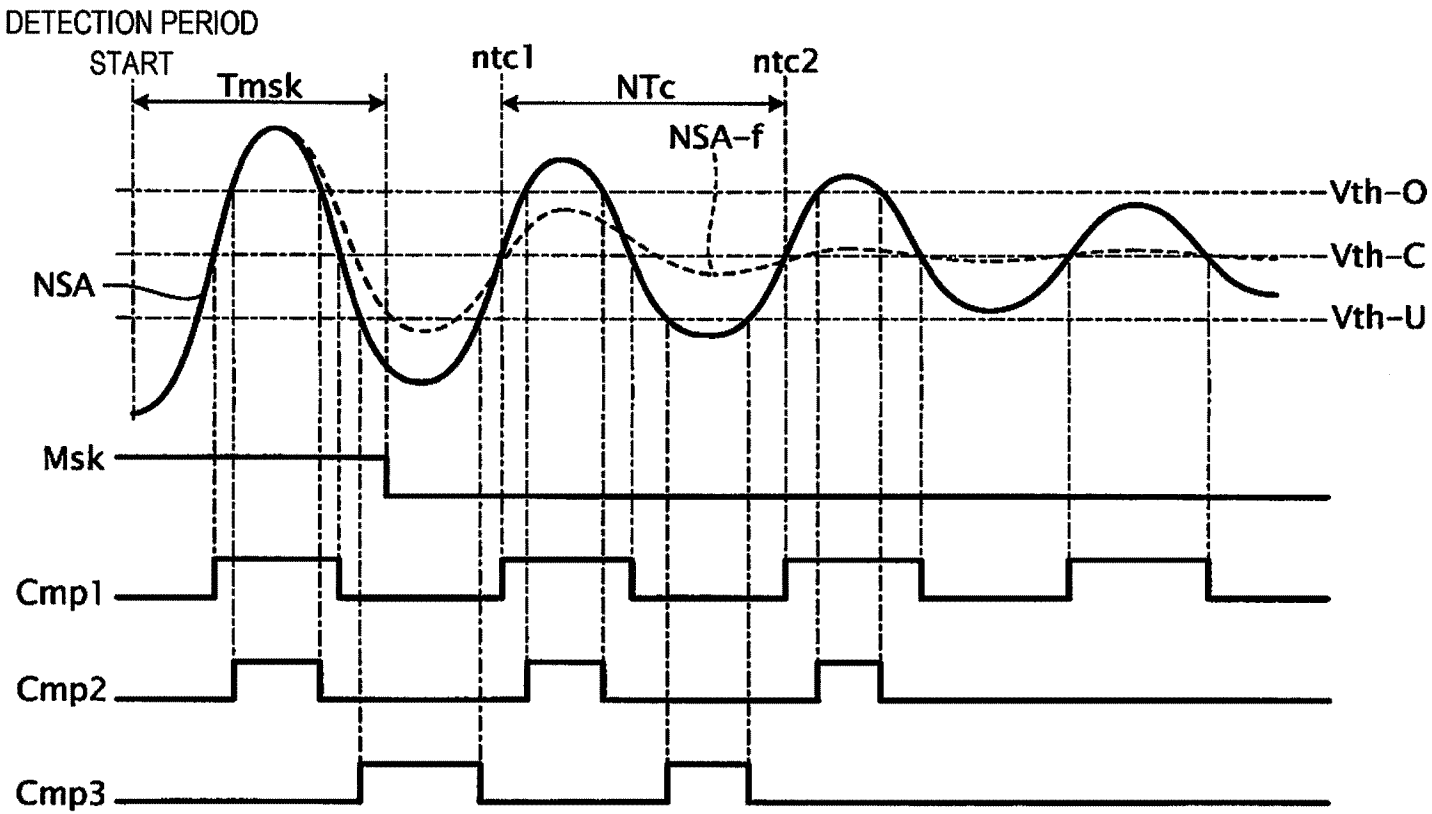
FIG. 13 is a diagram for explaining period information and explaining amplitude information.

FIG. 13 is a timing chart for explaining an example of an operation of generating the period information Info-T and the amplitude information Info-S in the discharge state determination circuit 9.

As illustrated in FIG. 13, when the detection period is started and supply of the residual vibration signal NSA is started, the discharge state determination circuit 9 compares the residual vibration signal NSA, a threshold potential Vth-C which is a potential corresponding to the center of the waveform of the residual vibration signal NSA, a threshold potential Vth-O which is a potential higher than the threshold potential Vth-C, and a threshold potential Vth-U which is a potential lower than the threshold potential Vth-C, with each other. Then, the discharge state determination circuit 9 generates a comparison signal Cmp1 that transitions into a high level in a case where the potential of the residual vibration signal NSA is equal to or higher than the threshold potential Vth-C, a comparison signal Cmp2 that transitions into a high level in a case where the potential of the residual vibration signal NSA is equal to or higher than the threshold potential Vth-O, and a comparison signal Cmp3 that transitions into a high level in a case where the potential of the residual vibration signal NSA less than the threshold potential Vth-U.

Then, the discharge state determination circuit 9 counts the clock signal CL over a period from a time ntc1 to a time ntc2 and generates the period information Info-T that indicates the obtained count value. The time ntc1 is the first time the comparison signal Cmp1 rises up to a high level after a mask signal Msk, which is at a high level only for a period Tmsk after the start of the detection period, falls down to a low level, and the time ntc2 is the second time the comparison signal Cmp1 rises up to a high level.

As indicated by a broken line NSA-f in FIG. 13, in a case where the amplitude of the residual vibration signal NSA is small, it can be deduced that there is a discharge abnormality in the determination target discharging unit D-H such as the absence of ink filling the cavity 320. In a case where the potential of the residual vibration signal NSA becomes equal to or higher than the threshold potential Vth-O and the potential of the residual vibration signal NSA becomes less than the threshold potential Vth-U thereafter within a period from the time ntc1 to the time ntc2, that is, in a case where the comparison signal Cmp2 transitions into a high level and the comparison signal Cmp3 transitions into a high level thereafter within a period from the time ntc1 to the time ntc2, the discharge state determination circuit 9 sets the value of the amplitude information Info-S to "1". Otherwise, the discharge state determination circuit 9 sets the value of the amplitude information Info-S to "0".

FIG. 14 is a diagram for explaining generation of the determination result signal Stt in the discharge state determination circuit 9.

As illustrated in FIG. 14, the discharge state determination circuit 9 compares the time length NTc indicated by the period information Info-T with all or a portion of a threshold Tth1, a threshold Tth2, and a threshold Tth3 to determine the discharge state of the determination target discharging unit D-H. The discharge state determination circuit 9 generates the determination result signal Stt which indicates the result of the determination.

Here, the threshold Tth1 is a value for indicating a boundary between a time length of one period of the residual vibration in a case where the discharge state of the determination target discharging unit D-H is normal and a time length of one period of residual vibration in a case where there are bubbles intruding into the cavity 320. In addition, the threshold Tth2 is a value for indicating a boundary between a time length of one period of the residual vibration in a case where the discharge state of the determination target discharging unit D-H is normal and a time length of one period of residual vibration in a case where there are foreign substances attached to the vicinity of the nozzle N. In addition, the threshold Tth3 is a value for indicating a boundary between a time length of one period of the residual vibration in a case where there are foreign substances attached to the vicinity of the nozzle N of the determination target discharging unit D-H and a time length of one period of residual vibration in a case where there is an increase in viscosity of ink in the cavity 320. Note that, the thresholds Tth1 to Tth3 satisfy "Tth1<Tth2<Tth3".

As illustrated in FIG. 14, in the first embodiment, in a case where the value of the amplitude information Info-S is "1", and the time length NTc indicated by the period information Info-T satisfies "Tth1≤NTc≤Tth2", the ink discharge state of the determination target discharging unit D-H is regarded as normal. Furthermore, in this case, the discharge state determination circuit 9 sets the value of the determination result signal Stt to "1" to indicate that the ink discharge state of the determination target discharging unit D-H is normal.

In addition, in a case where the value of the amplitude information Info-S is "1", and the time length NTc indicated by the period information Info-T satisfies "NTc<Tth1", it is considered that there is a discharge abnormality due to bubbles in the determination target discharging unit D-H. In this case, the discharge state determination circuit 9 sets the value of the determination result signal Stt to "2" to indicate that there is a discharge abnormality due to bubbles in the determination target discharging unit D-H.

In addition, in a case where the value of the amplitude information Info-S is "1", and the time length NTc indicated by the period information Info-T satisfies "Tth2<NTc≤Tth3", it is considered that there is a discharge abnormality due to foreign substances in the determination target discharging unit D-H. In this case, the discharge state determination circuit 9 sets the value of the determination result signal Stt to "3" to indicate that there is a discharge abnormality due to foreign substances in the determination target discharging unit D-H.

In addition, in a case where the value of the amplitude information Info-S is "1", and the time length NTc indicated by the period information Info-T satisfies "Tth3<NTc", it is considered that there is a discharge abnormality due to an increase in viscosity in the determination target discharging unit D-H. In this case, the discharge state determination circuit 9 sets the value of the determination result signal Stt to "4" to indicate that there is a discharge abnormality due to an increase in viscosity in the determination target discharging unit D-H.

In addition, even in a case where the value of the amplitude information Info-S is "0", it is considered that there is a discharge abnormality in the determination target discharging unit D-H. In this case, the discharge state determination circuit 9 sets the value of the determination result signal Stt to "5" to indicate that there is a discharge abnormality in viscosity in the determination target discharging unit D-H.

As described above, the discharge state determination circuit 9 generates the determination result signal Stt on the basis of the period information Info-T and the amplitude information Info-S.

In the first embodiment, a case where the determination result signal Stt is quinary information of "1" to "5" has been described. However, the determination result signal Stt may be binary information which indicates whether or not the time length satisfies "Tth1≤NTc≤Tth2". Any information can be used as the determination result signal Stt as long as the information include information indicating whether the ink discharge state of the determination target discharging unit D-H is normal.

8. Conclusion of First Embodiment

As described above, the ink jet printer 1 according to the first embodiment performs the discharge state determination using the residual vibration signal NSA which is generated on the basis of the detected signal Vout and the reference signal Vrf. Accordingly, even in a case where a noise, which is caused by a change in potential of a signal having large amplitude such as the driving signal Com-A, is superimposed on the detected signal Vout as in a case where the printing process and the discharge state determination process are executed within the same unit period Tu, it is possible to decrease or cancel out the noise superimposed on the detected signal Vout using the reference signal Vrf and to generate the residual vibration signal NSA. Therefore, it is possible to perform the discharge state determination at a high accuracy using the residual vibration signal NSA on which the residual vibration generated in the determination target discharging unit D-H is accurately reflected.

Hereinafter, an effect of the first embodiment will be described in more detail with reference to FIG. 15.

Figure 15:
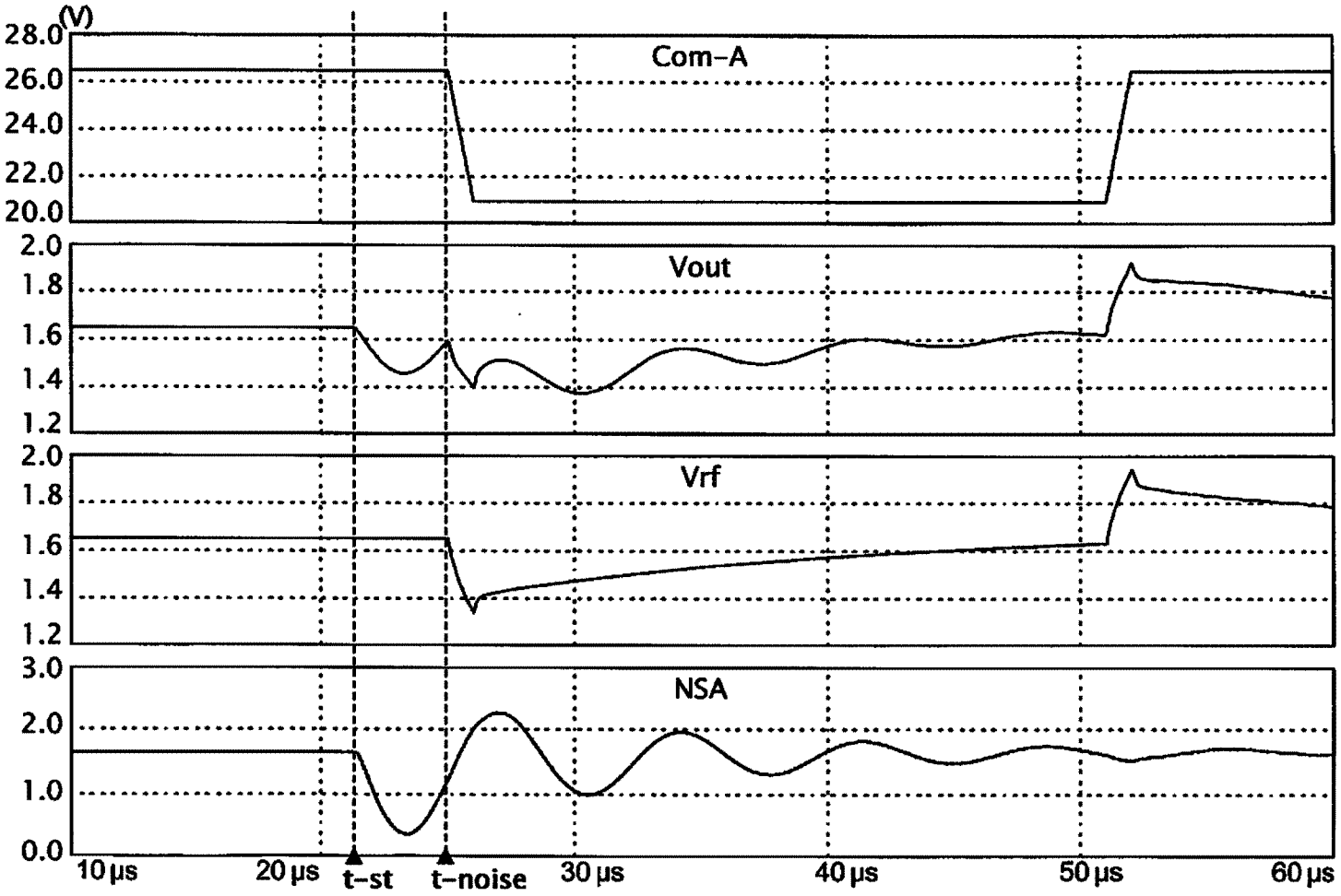
FIG. 15 shows the result of a simulation related to potentials of a detected signal and a residual vibration signal.

FIG. 15 shows the result of a simulation for calculating potentials of the detected signal Vout, the reference signal Vrf, and the residual vibration signal NSA in a case where detection of the detected signal Vout performed by the detection circuit 20 and generation of the residual vibration signal NSA performed by the detection circuit 20 are started at a time t-st, that is, at the same time, after the start of the control period TSS2 and the detection period. In the simulation, it is assumed that the potential of the driving signal Com-A is changed at a time t-noise and the change in potential is superimposed on the detected signal Vout and the reference signal Vrf. In addition, in the simulation, for convenience of explanation, the waveform of the driving signal Com-A made different from that in the above-described embodiment.

As illustrated in FIG. 15, when detection of the detected signal Vout is started at the time t-st, the detection circuit 20 outputs the residual vibration signal NSA which is obtained by amplifying the detected signal Vout with a predetermined amplification factor. Thereafter, when the potential of the driving signal Com-A is changed at the time t-noise, the change in potential of the driving signal Com-A at the time t-noise is superimposed on the detected signal Vout as a noise. In addition, the change in potential of the driving signal Com-A is also superimposed on the reference signal Vrf as a noise.

In FIG. 15, the detected signal Vout can accurately indicate the residual vibration in the determination target discharging unit D-H before the time t-noise. However, the detected signal Vout is significantly influenced by the noise due to the change in potential of the driving signal Com-A after the time t-noise. Therefore, the detected signal Vout becomes incapable of accurately indicating the residual vibration in the determination target discharging unit D-H.

However, in the first embodiment, as illustrated in FIG. 15, the residual vibration signal NSA is generated by eliminating a noise superimposed on the detected signal Vout through the division or the like of the potential of the detected signal Vout by a potential according to the potential of the reference signal Vrf. Accordingly, as illustrated in FIG. 15, even in a case where a noise is superimposed on the detected signal Vout, the residual vibration signal NSA can accurately indicate the residual vibration in the determination target discharging unit D-H. Therefore, according to the first embodiment, it is possible to perform the discharge state determination at a favorable accuracy.

Furthermore, in the first embodiment, the residual vibration signal NSA is generated which is obtained by eliminating a noise due to the driving signal Com-A or the like from the detected signal Vout on which the noise is superimposed, and the discharge state determination is performed on the basis of the residual vibration signal NSA. That is, in the first embodiment, even in a case where the driving of the discharging unit D being used for the printing process using the driving signal Com-A and the detection of the detected signal Vout from the determination target discharging unit D-H which is the target of the discharge state determination are performed within the same unit period Tu, it is possible to suppress a decrease in accuracy of the discharge state determination and to maintain a favorable determination accuracy. That is, in the first embodiment, the printing process and the discharge state determination process can be performed within the same unit period Tu, and thus it is possible to reduce the load on a user of the ink jet printer 1 in execution of the discharge state determination process in comparison with a case where the printing process and the discharge state determination process need to be performed at different unit periods Tu. In other words, according to the ink jet printer 1 of the first embodiment, it is possible to reduce the load on a user of the ink jet printer 1 in execution of the discharge state determination process and to prevent a decrease in printing quality due to execution of the discharge state determination process at the same time.

Furthermore, in the first embodiment, the number of discharging units D[m1] belonging to the group GL1 and the number of discharging units D[m2] belonging to the group GL2 are the same (that is, Mo). Accordingly, according to the first embodiment, in comparison with a case where the number of discharging units D[m1] belonging to the group GL1 and the number of discharging units D[m2] belonging to the group GL2 are different from each other (hereinafter, referred to as "Comparative example 1"), it is possible to make the difference between a capacity value of parasitic capacitance of the internal wire LHs1 and a capacity value of parasitic capacitance of the internal wire LHs2 small. More specifically, according to the first embodiment, it is possible to make the difference between a capacity value of parasitic capacitance between the internal wire LHs1 and the switch SWs[m1] corresponding to the discharging unit D[m1] belonging to the group GL1 and a capacity value of parasitic capacitance between the internal wire LHs2 and the switch SWs[m2] corresponding to the discharging unit D[m2] belonging to the group GL2 small. Therefore, according to the first embodiment, in comparison with Comparative example 1, it is possible to make the difference between the noise sensitivity of the internal wire LHs1 and the noise sensitivity of the internal wire LHs2 small. The noise sensitivity of the internal wire LHs1 and the noise sensitivity of the internal wire LHs2 are related to a noise superimposed on the internal wires LHs1 and LHs2 that is accompanied by a change in potential of the driving signal Com-A. In addition, according to the first embodiment, it is possible to perform the elimination of the noise superimposed on the detected signal Vout using the reference signal Vrf, at a higher frequency than in Comparative example 1. Therefore, according to the first embodiment, it is possible to accurately detect the residual vibration generated in the determination target discharging unit D-H, and to maintain a favorable discharge state determination accuracy.

In addition, in the first embodiment, the discharging units D[m1] belonging to the group GL1 and the discharging units D[m2] belonging to the group GL2 are alternately arranged, and thus it is possible to make a capacity value of parasitic capacitance of the internal wire LHs1 and a capacity value of parasitic capacitance of the internal wire LHs2 approximately the same and to make the difference between the noise sensitivity of the internal wire LHs1 and the noise sensitivity of the internal wire LHs2 small. Therefore, it is possible to more accurately eliminate a noise superimposed on the detected signal Vout using the reference signal Vrf.

In the first embodiment, the determination target discharging unit D-H belonging to one of the group GL1 and the group GL2 corresponds to "first discharging unit" and the determination target discharging unit D-H belonging to the other of the group GL1 and the group GL2 corresponds to "second discharging unit".

In addition, the piezoelectric element PZ included in the determination target discharging unit D-H that corresponds to the first discharging unit is an example of "first piezoelectric element", the upper electrode Zu of this piezoelectric element PZ is an example of "first electrode", the cavity 320 of this determination target discharging unit D-H is an example of "first pressure chamber", and the nozzle N of this determination target discharging unit D-H is an example of "first nozzle".

In addition, the piezoelectric element PZ included in the determination target discharging unit D-H that corresponds to the second discharging unit is an example of "second piezoelectric element", the upper electrode Zu of this piezoelectric element PZ is an example of "second electrode", the cavity 320 of this determination target discharging unit D-H is an example of "second pressure chamber", and the nozzle N of this determination target discharging unit D-H is an example of "second nozzle".

A wire which is electrically connected to the upper electrode Zu of the discharging unit D belonging to one of the group GL1 and the group GL2 in the internal wires LHs1 and LHs2, that is, a wire which is electrically connected to the upper electrode Zu corresponding to the first electrode is an example of "first wire", and a wire which is electrically connected to the upper electrode Zu of the discharging unit D belonging to the other of the group GL1 and the group GL2, that is, a wire which is electrically connected to the upper electrode Zu corresponding to the second electrode is an example of "second wire".

In addition, the detected signal Vout detected from the upper electrode Zu corresponding to the first electrode via the first wire is an example of "first detected signal", and the reference signal Vrf detected from the second wire in the unit period Tu in which the first detected signal is detected is an example of "first reference signal". The detected signal Vout detected from the upper electrode Zu corresponding to the second electrode via the second wire is an example of "second detected signal", and the reference signal Vrf detected from the first wire in the unit period Tu in which the second detected signal is detected is an example of "second reference signal". The detection period in which the first detected signal is detected is an example of "first detection period", and the detection period in which the second detected signal is detected is an example of "second detection period".

In addition, the residual vibration signal NSA that is generated on the basis of the signal Out1 and the signal Out2 is an example of "difference detection signal".

In addition, a signal having a signal level according to the residual vibration in the first discharging unit, such as the residual vibration signal NSA or the difference signal Vdif which is generated on the basis of the first detected signal and the first reference signal, is an example of "first residual vibration signal" and a signal having a signal level according to the residual vibration in the second discharging unit, such as the residual vibration signal NSA or the difference signal Vdif which is generated on the basis of the second detected signal and the second reference signal, is an example of "second residual vibration signal".

B. Second Embodiment

Hereinafter, a second embodiment of the invention will be described. Note that, in embodiments described below, elements of which the operation or function is the same as in the first embodiment are given the same symbols as in the first embodiment and detailed description thereof will be appropriately omitted.

In the first embodiment, in a case where the discharge state determination process is performed, the reference signal Vrf is detected from the reference unit D-rf in the unit period Tu in which the detected signal Vout is detected from the determination target discharging unit D-H. On the other hand, in the second embodiment, in a case where the discharge state determination process is performed, the reference signal Vrf is detected from the discharging unit D belonging to a group GL that is different from a group GL which the determination target discharging unit D-H belongs to, in the unit period Tu in which the detected signal Vout is detected from the determination target discharging unit D-H. The second embodiment is different from the first embodiment in that point. Hereinafter, the discharging unit D as the target of detection of the reference signal Vrf is referred to as a reference target discharging unit D-R. That is, the detection circuit 20 according to the second embodiment detected the detected signal Vout from the determination target discharging unit D-H belonging to one of the group GL1 and the group GL2, and detects the reference signal Vrf from the reference target discharging unit D-R belonging to the other of the group GL1 and the group GL2, in the unit period Tu in which the discharge state determination process is performed.

Figure 16:
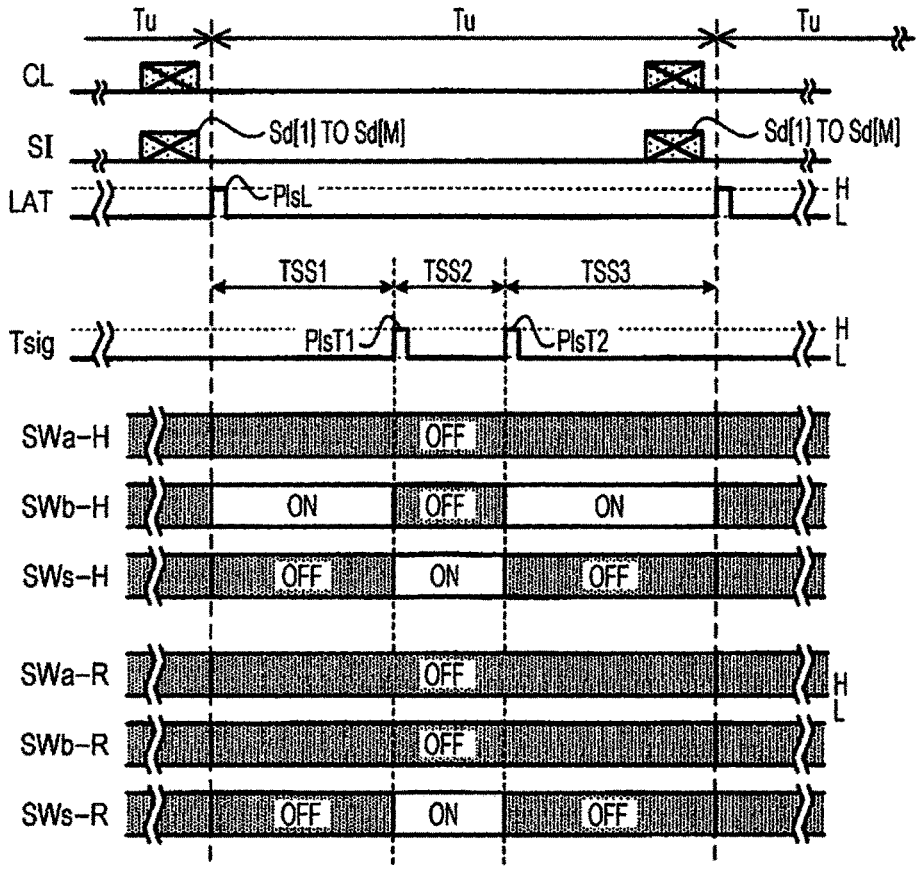
FIG. 16 is a diagram for explaining a discharge state determination process according to a second embodiment.

FIG. 16 is a diagram for explaining the operation of three switches (switches SWa, SWb, and SWs) which are provided corresponding to the determination target discharging unit D-H and the operation of three switches which are provided corresponding to the reference target discharging unit D-R in a case where the ink jet printer according to the second embodiment performs the discharge state determination process. Hereinafter, the three switches which are provided corresponding to the determination target discharging unit D-H are referred to as switches SWa-H, SWb-H, and SWs-H, respectively. The three switches which are provided corresponding to the reference target discharging unit D-R are referred to as switches SWa-R, SWb-R, and SWs-R, respectively.

As illustrated in FIG. 16, in a case where the discharge state determination process is performed in the unit period Tu, the switch SWa-H is turned off for the unit period Tu, the switch SWb-H is turned on for the control periods TSS1 and TSS3 and is turned off for the control period TSS2, and the switch SWs-H is turned on for the control period TSS2 and is turned off for the control periods TSS1 and TSS3. As a result of this, in the control period TSS1, the piezoelectric element PZ of the determination target discharging unit D-H is driven by the driving signal Com-B, and there is residual vibration remaining in the determination target discharging unit D-H for the control period TSS2.

On the other hand, in a case where the discharge state determination process is performed in the unit period Tu, the switches SWa-R and SWb-R are turned off for the unit period Tu, the switch SWs-R is turned on for the control period TSS2 and is turned off for the control periods TSS1 and TSS3. Therefore, in the unit period Tu, the potential of the upper electrode Zu of the piezoelectric element PZ of the reference target discharging unit D-R is maintained at a predetermined level such as the reference potential V0.

In addition, in the control period TSS2 which is a portion of the unit period Tu in which the discharge state determination process is executed, the detection circuit 20 detects the potential of the upper electrode Zu of the determination target discharging unit D-H belonging to one of the group GL1 and the group GL2 as the detected signal Vout via one of the internal wires LHs1 and LHs2, and detects the potential of the upper electrode Zu of the reference target discharging unit D-R belonging to the other of the group GL1 and the group GL2 as the reference signal Vrf via the other of the internal wires LHs1 and LHs2.

In the second embodiment, it is assumed that, as illustrated in FIG. 16, the potential of the upper electrode Zu of the reference target discharging unit D-R is maintained at a constant level for the unit period Tu by stopping supply of the driving signal Com to the piezoelectric element PZ of the reference target discharging unit D-R in the unit period Tu in which the discharge state determination process is executed. However, this is merely an example, and any method of maintaining the potential of the upper electrode Zu of the reference target discharging unit D-R at a predetermined level can be used. For example, a predetermined potential may be supplied to the upper electrode Zu of the piezoelectric element PZ of the reference target discharging unit D-R for the unit period Tu in which the discharge state determination process is executed.

Figure 17A:
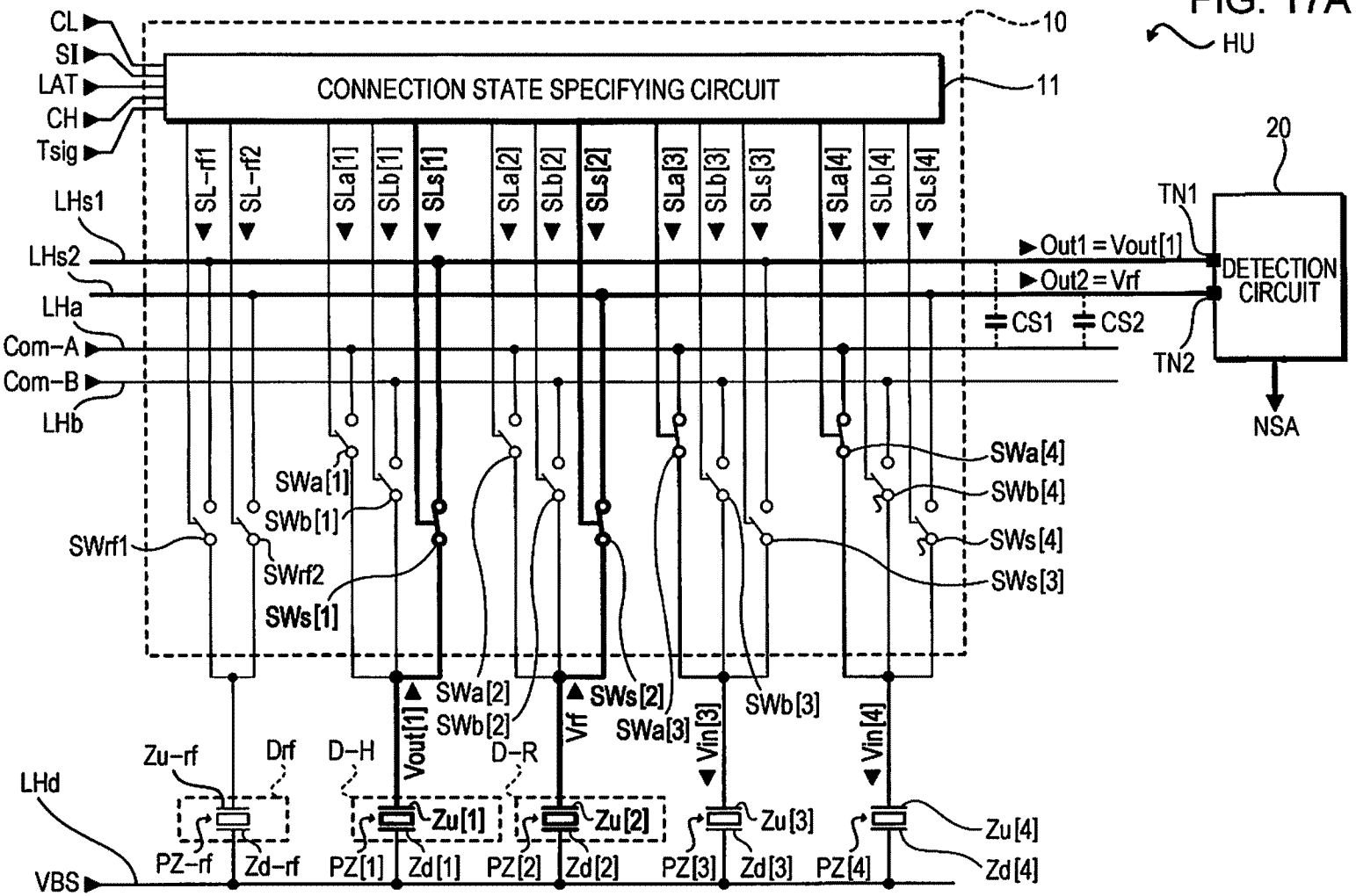
FIG. 17A is a diagram for explaining the discharge state determination process according to the second embodiment.
Figure 17B:
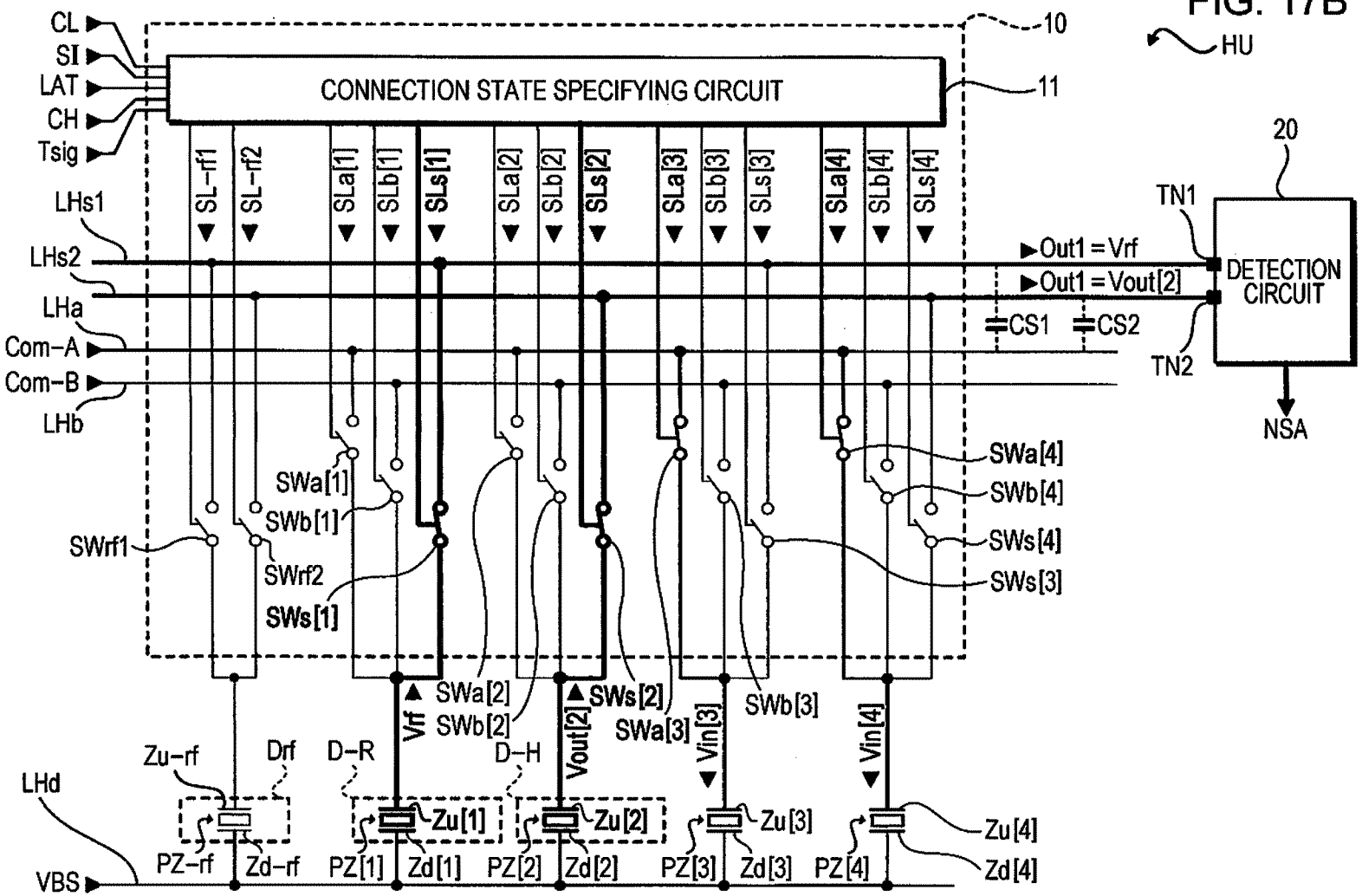
FIG. 17B is a diagram for explaining the discharge state determination process according to the second embodiment.

FIGS. 17A and 17B are diagrams for explaining the operation of the switching circuit 10 in the control period TSS2 which is a portion of the unit period Tu in which the discharge state determination process is executed.

In FIGS. 17A and 17B, a case where the head unit HU includes the reference unit D-rf and the switches SWrf1 and SWrf2 is described. However, this is merely an example, and the head unit HU according to the second embodiment may be configured to not include the reference unit D-rf.

FIG. 17A is a diagram for explaining the operation of the switching circuit 10 in a case where the discharging unit D[1] which is an example of the discharging unit D[m1] belonging to the group GL1 is selected as the determination target discharging unit D-H and the discharging unit D[2] which is an example of the discharging unit D[m2] belonging to the group GL2 is selected as the reference target discharging unit D-R. As illustrated in FIG. 17A, in a case where the discharging unit D[1] is selected as the determination target discharging unit D-H and the discharging unit D[2] is selected as the reference target discharging unit D-R, in the control period TSS2, the detected signal Vout[1] for indicating the residual vibration generated in the discharging unit D[1] is supplied to the connection node TN1 as the signal Out1 via the switch SWs[1] and the internal wire LHs1, and the reference signal Vrf for indicating the potential of the upper electrode Zu of the discharging unit D[2] is supplied to the connection node TN2 as the signal Out2 via the switch SWs[2] and the internal wire LHs2. Then, the detection circuit 20 generates the residual vibration signal NSA by reducing or canceling out a noise superimposed on the detected signal Vout[1] using a noise superimposed on the reference signal Vrf.

FIG. 17B is a diagram for explaining the operation of the switching circuit 10 in a case where the discharging unit D[2] which is an example of the discharging unit D[m2] belonging to the group GL2 is selected as the determination target discharging unit D-H and the discharging unit D[1] which is an example of the discharging unit D[m1] belonging to the group GL1 is selected as the reference target discharging unit D-R. As illustrated in FIG. 17B, in a case where the discharging unit D[2] is selected as the determination target discharging unit D-H and the discharging unit D[1] is selected as the reference target discharging unit D-R, in the control period TSS2, the detected signal Vout[2] for indicating the residual vibration generated in the discharging unit D[2] is supplied to the connection node TN2 as the signal Out2 via the switch SWs[2] and the internal wire LHs2, and the reference signal Vrf for indicating the potential of the upper electrode Zu of the discharging unit D[1] is supplied to the connection node TN1 as the signal Out1 via the switch SWs[1] and the internal wire LHs1. Then, the detection circuit 20 generates the residual vibration signal NSA by reducing or canceling out a noise superimposed on the detected signal Vout[2] using a noise superimposed on the reference signal Vrf.

Note that, in FIGS. 17A and 17B, it is assumed that, the printing process is also executed in the unit period Tu in which the discharge state determination process is executed and the discharging units D[3] and D[4], which are discharging units D other than the determination target discharging unit D-H and the reference target discharging unit D-R, are driven on the basis of the individual specifying signal Sd.

FIG. 18 is a diagram for explaining the individual specifying signal Sd[m] according to the second embodiment and for explaining generation of the connection state specifying signals SLa[m], SLb[m], and SLs[m] performed by the connection state specifying circuit 11 according to the second embodiment.

As illustrated in FIG. 18, the individual specifying signal Sd[m] according to the second embodiment indicates any one of six values of a value (1, 1, 0) for specifying formation of a large dot, a value (1, 0, 0) for specifying formation of a medium dot, a value (0, 1, 0) for specifying formation of a small dot, a value (0, 0, 0) for specifying non-discharge of ink, a value (1, 1, 1) for specifying driving of the discharging unit D[m] as the determination target discharging unit D-H, and a value (0, 0, 1) for specifying driving of the discharging unit D[m] as the reference target discharging unit D-R. In addition, in a case where the individual specifying signal Sd[m] indicates (1, 1, 0), the decoder DC[m] according to the second embodiment sets the connection state specifying signal SLa[m] to be at the high level for the control periods Tu1 and Tu2, in a case where the individual specifying signal Sd[m] indicates (1, 0, 0), the decoder DC[m] sets the connection state specifying signal SLa[m] to be at the high level for the control period Tu1, in a case where the individual specifying signal Sd[m] indicates (0, 1, 0), the decoder DC[m] sets the connection state specifying signal SLa[m] to be at the high level for the control period Tu2, in a case where the individual specifying signal Sd[m] indicates (1, 1, 1), the decoder DC[m] sets the connection state specifying signal SLb[m] to be at the high level for the control periods TSS1 and TSS3 and sets the connection state specifying signal SLs[m] to be at the high level for the control period TSS2, in a case where the individual specifying signal Sd[m] indicates (0, 0, 1), the decoder DC[m] sets the connection state specifying signal SLs[m] to be at the high level for the control period TSS2, and in a case where any one of the above conditions is not satisfied, the decoder DC[m] sets each signal to be at the low level.

As described above, in the second embodiment, the decoder DC[m] decodes the individual specifying signal Sd[m] and generates the connection state specifying signals SLa[m], SLb[m], and SLs[m] as in FIG. 18. Therefore, in the unit period Tu in which the discharge state determination process is executed, the detected signal Vout is detected from the determination target discharging unit D-H and the reference signal Vrf is detected from the reference target discharging unit D-R.

Note that, in a case where only the printing process is executed in the unit period Tu, the controller 6 according to the second embodiment generates the individual specifying signal Sd[m], which indicates any one of four values of a value (1, 1, 0) for specifying formation of a large dot, a value (1, 0, 0) for specifying formation of a medium dot, a value (0, 1, 0) for specifying formation of a small dot, and a value (0, 0, 0) for specifying non-discharge of ink, on the basis of the printing data Img in order to specify the operation of the discharging unit D[m] in the unit period Tu.

In addition, in a case where only the discharge state determination process is executed in the unit period Tu, the controller 6 according to the second embodiment generates the individual specifying signal Sd[m], which indicates any one of three values of a value (0, 0, 0) for specifying non-discharge of ink, a value (1, 1, 1) for specifying driving of the discharging unit D[m] as the determination target discharging unit D-H, and a value (0, 0, 1) for specifying driving of the discharging unit D[m] as the reference target discharging unit D-R in order to specify the operation of the discharging unit D[m] in the unit period Tu. In this case, it is preferable that the controller 6 select a discharging unit D which is most close to the determination target discharging unit D-H in the discharging units D belonging to a group GL that is different from a group GL which the determination target discharging unit D-H belongs to, as the reference target discharging unit D-R. That is, in a case where one discharging unit D[m1] belonging to the group GL1 is selected as the determination target discharging unit D-H and the other discharging unit D[m2] belonging to the group GL2 is selected as the reference target discharging unit D-R in one unit period Tu, it is preferable that the controller 6 select the other discharging unit D[m2] belonging to the group GL2 as the determination target discharging unit D-H and select the one discharging unit D[m1] belonging to the group GL1 as the reference target discharging unit D-R in the other unit period Tu.

In addition, in a case where both the printing process and the discharge state determination process are executed in the unit period Tu, the controller 6 according to the second embodiment generates the individual specifying signal Sd[m], which indicates any one of six values of a value (1, 1, 0), a value (1, 0, 0), a value (0, 1, 0), a value (0, 0, 0), a value (1, 1, 1), and a value (0, 0, 1), in order to specify the operation of the discharging unit D [m] in the unit period Tu.

Specifically, first, the controller 6 temporarily assigns any one of four values of a value (1, 1, 0) for specifying formation of a large dot, a value (1, 0, 0) for specifying formation of a medium dot, a value (0, 1, 0) for specifying formation of a small dot, and a value (0, 0, 0) for specifying non-discharge of ink, to each of individual specifying signals Sd[1] to Sd[M] according to the printing data Img.

Second, the controller 6 selects the determination target discharging unit D-H and the reference target discharging unit D-R from the discharging units D to which a value (0, 0, 0) for specifying non-discharge of ink is assigned as the individual specifying signal Sd[m], in M discharging units D[1] to D[M]. In this case, if there are a plurality of discharging units D which are selectable as the reference target discharging unit D-R, it is preferable to select a discharging unit D which is most close to the determination target discharging unit D-H as the reference target discharging unit D-R from the discharging units D which are selectable as the reference target discharging unit D-R.

As described above, in the ink jet printer according to the second embodiment, the discharge state determination is performed using the residual vibration signal NSA, which is generated on the basis of the detected signal Vout detected from the determination target discharging unit D-H and the reference signal Vrf detected from the reference target discharging unit D-R. Accordingly, even in a case where a noise is superimposed on the detected signal Vout, it is possible to reduce or cancel out the noise using a noise superimposed on the reference signal Vrf. Therefore, it is possible to generate the residual vibration signal NSA on which the residual vibration generated in the determination target discharging unit D-H is accurately reflected, and to determine the ink discharge state of the determination target discharging unit D-H at a high accuracy.

In the second embodiment, the controller 6 selects the reference target discharging unit D-R as the target of detection of the reference signal Vrf. However, the invention is not limited to the embodiment, and the controller 6 may select the target of detection of the reference signal Vrf between the reference target discharging unit D-R and the reference unit D-rf. For example, in a case where a distance between the determination target discharging unit D-H and the reference target discharging unit D-R is larger than a distance between the determination target discharging unit D-H and the reference unit D-rf, the controller 6 may select the reference unit D-rf as the target of detection of the reference signal Vrf, and in a case where a distance between the determination target discharging unit D-H and the reference target discharging unit D-R is smaller than a distance between the determination target discharging unit D-H and the reference unit D-rf, the controller 6 may select the reference target discharging unit D-R as the target of detection of the reference signal Vrf.

C. Modification Examples

The above-described embodiments can be modified in various manners. Specific modification examples thereof will be described below. Two or more modification examples which are arbitrarily selected from the following modification examples can be combined without confliction. Note that, in the modification embodiments described below, elements of which the operation or function is the same as in the embodiments are given the same symbols as in the embodiments and detailed description thereof will be appropriately omitted.

Modification Example 1

In the above-described embodiments, the ink jet printer 1 is provided with four head units HU and four ink cartridges 31 such that one head unit HU corresponds to one ink cartridge 31. However, the invention is not limited to the embodiments, and the ink jet printer 1 may include one or more head units HU and one or more ink cartridges 31. In this case, one ink cartridge 31 may be provided to correspond to a plurality of head units HU and one head unit HU may be provided to correspond to a plurality of ink cartridges 31. For example, ink may be supplied from one ink cartridge 31 to a portion of M discharging units D[1] to D[M] which are provided in one head unit HU, and ink may be supplied from the other ink cartridge 31 to the remainder of the M discharging units D[1] to D[M].

Modification Example 2

In the above-described embodiments and modification example, the number of discharging units D belonging to the group GL1 and the number of discharging units D belonging to the group GL2 are the same. However, the invention is not limited to this, and the number of discharging units D belonging to the group GL1 and the number of discharging units D belonging to the group GL2 may be different from each other.

In this case, it is preferable that the number of discharging units D belonging to the group GL1 and the number of discharging units D belonging to the group GL2 be approximately the same. Here, the number of discharging units D belonging to the group GL1 and the number of discharging units D belonging to the group GL2 being approximately the same means that a difference between the number of discharging units D belonging to the group GL1 and the number of discharging units D belonging to the group GL2 is equal to or lower than a predetermined number, or that a proportion of a difference between the number of discharging units D belonging to the group GL1 and the number of discharging units D belonging to the group GL2 to the number of discharging units D belonging to the group GL1 or the group GL2 is equal to or lower than a predetermined value.

In addition, in a case where the number of discharging units D belonging to the group GL1 and the number of discharging units D belonging to the group GL2 are different from each other, it is preferable that the arrangement of the internal wires LHs1 and LHs2 and the switches SWs[1] to SWs[M] be adjusted such that a capacity value of parasitic capacitance between the internal wire LHs1 and the switch SWs corresponding to the discharging unit D belonging to the group GL1 and a capacity value of parasitic capacitance between the internal wire LHs2 and the switch SWs corresponding to the discharging unit D belonging to the group GL2 become approximately the same as each other.

Modification Example 3

In the above-described embodiments and modification examples, the detection circuit 20 includes the difference signal generation circuit 201 and the waveform shaping circuit 202, and the detection circuit 20 outputs the residual vibration signal NSA. However, the detection circuit 20 may not include the waveform shaping circuit 202 and may include the difference signal generation circuit 201 alone. In this case, the detection circuit 20 may output the difference signal Vdif and the discharge state determination circuit 9 may perform the discharge state determination on the basis of the difference signal Vdif. Note that, in Modification Example 3, the difference signal Vdif is an example of "difference detection signal".

Modification Example 4

In the above-described embodiments and modification examples, it is assumed that the ink jet printer 1 is a serial printer. However, the invention is not limited to this, and the ink jet printer 1 may be a so-called line printer in which the head module HM is provided with a plurality of nozzles N extending wider than the width of the recording medium P.

What is claimed is:

1. A liquid discharging apparatus comprising:

a first piezoelectric element that includes a pair of electrodes including a first electrode and that is displaced according to a potential change of a driving signal in a case where the driving signal is supplied to the first electrode;

a first pressure chamber of which a volume changes in response to displacement of the first piezoelectric element;

a first nozzle from which liquid filling the first pressure chamber can be discharged in response to a change in volume of the first pressure chamber;

a reference piezoelectric element that includes a pair of electrodes including a reference electrode;

an internal space of which a volume changes in response to displacement of the reference piezoelectric element; and a detecting unit that detects a potential of the first electrode via a first wire and detects a potential of the reference electrode via a second wire in a first detection period which is a period after the first piezoelectric element is displaced due to the driving signal, wherein the internal space is not filled with the liquid.

2. The liquid discharging apparatus according to claim 1, wherein the detecting unit outputs a difference detection signal which indicates a potential difference between a potential detected via the first wire and a potential detected via the second wire.

3. The liquid discharging apparatus according to claim 2, further comprising:

a determination unit that determines whether or not a discharging unit which includes the first piezoelectric element, the first pressure chamber, and the first nozzle can discharge liquid filling the first pressure chamber in response to a potential change of the driving signal supplied to the first electrode on the basis of the difference detection signal.

4. A liquid discharging apparatus comprising:

a first piezoelectric element that includes a pair of electrodes including a first electrode and that is displaced according to a potential change of a driving signal in a case where the driving signal is supplied to the first electrode;

a first pressure chamber of which a volume changes in response to displacement of the first piezoelectric element;

a first nozzle from which liquid filling the first pressure chamber can be discharged in response to a change in volume of the first pressure chamber;

a second piezoelectric element that includes a pair of electrodes including a second electrode and that is displaced according to a potential change of the driving signal in a case where the driving signal is supplied to the second electrode;

a second pressure chamber of which a volume changes in response to displacement of the second piezoelectric element;

a second nozzle from which liquid filling the second pressure chamber can be discharged in response to a change in volume of the second pressure chamber;

a reference piezoelectric element that includes a pair of electrodes including a reference electrode; and a detecting unit that detects a potential of the first electrode via a first wire and detects a potential of the reference electrode via a second wire in a first detection period which is a period after the first piezoelectric element is displaced due to the driving signal and that detects a potential of the second electrode via the second wire and detects a potential of the reference electrode via the first wire in a second detection period which is a period after the second piezoelectric element is displaced due to the driving signal.

5. The liquid discharging apparatus according to claim 4, wherein a plurality of piezoelectric elements including the first piezoelectric element and the second piezoelectric element are provided, and the number of piezoelectric elements with an electrode, of which a potential can be detected by the detecting unit via the first wire, in the plurality of piezoelectric elements is approximately the same as the number of piezoelectric elements with an electrode, of which a potential can be detected by the detecting unit via the second wire, in the plurality of piezoelectric elements.

6. The liquid discharging apparatus according to claim 5, wherein the plurality of piezoelectric elements are arranged extending along a predetermined direction, and the piezoelectric elements with an electrode, of which a potential can be detected by the detecting unit via the first wire, and the piezoelectric elements with an electrode, of which a potential can be detected by the detecting unit via the second wire, are alternately arranged.

7. The liquid discharging apparatus according to claim 5, wherein, in the first detection period and the second detection period, the driving signal is supplied to at least a portion of the plurality of piezoelectric elements.

8. The liquid discharging apparatus according to claim 4, further comprising:

an internal space of which a volume changes in response to displacement of the reference piezoelectric element, wherein the internal space is not filled with the liquid.

9. A head unit which is provided in a liquid discharging apparatus, the head unit comprising:

a first piezoelectric element that includes a pair of electrodes including a first electrode and that is displaced according to a potential change of a driving signal in a case where the driving signal is supplied to the first electrode;

a first pressure chamber of which a volume changes in response to displacement of the first piezoelectric element;

a first nozzle from which liquid filling the first pressure chamber can be discharged in response to a change in volume of the first pressure chamber;

a reference piezoelectric element that includes a pair of electrodes including a reference electrode;

an internal space of which a volume changes in response to displacement of the reference piezoelectric element; and a detecting unit that detects a potential of the first electrode via a first wire and detects a potential of the reference electrode via a second wire in a first detection period which is a period after the first piezoelectric element is displaced due to the driving signal, wherein the internal space is not filled with the liquid.

10. A control method of a liquid discharging apparatus which includes a first piezoelectric element that includes a pair of electrodes including a first electrode and that is displaced according to a potential change of a driving signal in a case where the driving signal is supplied to the first electrode, a first pressure chamber of which a volume changes in response to displacement of the first piezoelectric element, a first nozzle from which liquid filling the first pressure chamber can be discharged in response to a change in volume of the first pressure chamber, a reference piezoelectric element that includes a pair of electrodes including a reference electrode, and an internal space of which a volume changes in response to displacement of the reference piezoelectric element, the method comprising:

detecting a potential of the first electrode via a first wire and detecting a potential of the reference electrode via a second wire in a first detection period which is a period after the first piezoelectric element is displaced due to the driving signal, wherein the internal space is not filled with the liquid.

* * * * *